US010676306B2

(12) United States Patent
Yoneda et al.

(10) Patent No.: US 10,676,306 B2
(45) Date of Patent: Jun. 9, 2020

(54) SHEET DISCHARGE DEVICE AND IMAGE FORMING APPARATUS INCLUDING THE SAME

(71) Applicant: Sharp Kabushiki Kaisha, Osaka (JP)

(72) Inventors: Yoshiharu Yoneda, Osaka (JP); Masahiko Fujita, Osaka (JP); Masaharu Kimura, Osaka (JP); Noriaki Taguchi, Osaka (JP); Yuji Sawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/116,297

(22) Filed: Aug. 29, 2018

(65) Prior Publication Data

US 2019/0010007 A1 Jan. 10, 2019

Related U.S. Application Data

(63) Continuation of application No. 15/294,874, filed on Oct. 17, 2016, now Pat. No. 10,087,030.

(30) Foreign Application Priority Data

Oct. 19, 2015 (JP) ..... 2015-205734
Jul. 29, 2016 (JP) ..... 2016-149681

(51) Int. Cl.
*B65H 31/02* (2006.01)
*B65H 29/52* (2006.01)
(Continued)

(52) U.S. Cl.
CPC ..... *B65H 31/02* (2013.01); *B65H 29/14* (2013.01); *B65H 29/52* (2013.01); *B65H 31/24* (2013.01);
(Continued)

(58) Field of Classification Search
CPC ..... B65H 31/22; B65H 31/34; B65H 31/02; B65H 29/52; B65H 29/58
See application file for complete search history.

(56) References Cited

U.S. PATENT DOCUMENTS 5,080,342 A * 1/1992 Mori ..... B42C 1/12 270/58.11
6,152,445 A * 11/2000 Hirota ..... B65H 29/06 271/185
(Continued)

FOREIGN PATENT DOCUMENTS

CN 101551607 A 10/2009
JP H03-023157 A 1/1991
(Continued)

OTHER PUBLICATIONS

Allowed claims of related U.S. Appl. No. 15/294,874.

*Primary Examiner* — Patrick Cicchino
(74) *Attorney, Agent, or Firm* — Renner, Otto, Boisselle & Sklar, LLP

(57) ABSTRACT

A sheet discharge device of the present invention includes discharge rollers configured to transport a sheet in a predetermined transport direction and to discharge the sheet to a discharge tray, and an upper discharge tray disposed above the discharge tray with a space being interposed therebetween. A bottom face of the upper discharge tray that faces the discharge tray includes a guide rib extending in an oblique direction inclined relative to the transport direction.

20 Claims, 15 Drawing Sheets

(51) Int. Cl.
*B65H 29/14* (2006.01)
*B65H 31/24* (2006.01)
*B65H 33/08* (2006.01)

(52) U.S. Cl.
CPC ..... *B65H 33/08* (2013.01); *B65H 2301/4212* (2013.01); *B65H 2404/1422* (2013.01); *B65H 2404/1424* (2013.01); *B65H 2405/115* (2013.01); *B65H 2405/332* (2013.01); *G03G 2215/00675* (2013.01)

(56) References Cited

U.S. PATENT DOCUMENTS 8,272,637 B2 * 9/2012 Asada ..... B65H 1/04 271/171
8,366,098 B2 * 2/2013 Kobayashi ..... B65H 1/266 271/145
8,579,282 B2 * 11/2013 Yoshida ..... B65H 31/02 271/209
8,820,742 B2 * 9/2014 Koyanagi ..... B65H 31/24 271/224
8,925,916 B2 * 1/2015 Honda ..... B65H 31/02 271/176
9,187,272 B2 * 11/2015 Kainuma ..... B65H 1/04
2009/0245906 A1 10/2009 Jeong et al.
2012/0018947 A1 * 1/2012 Kimura ..... B65H 33/08 271/256
2016/0147188 A1 * 5/2016 Yamamoto ..... B65H 1/266 271/171
2016/0288537 A1 * 10/2016 Hirose ..... B65H 39/11

FOREIGN PATENT DOCUMENTS

JP 10-017195 1/1998
JP H11-165934 A 6/1999
JP 2005-053648 A 3/2005
JP 2005-075547 3/2005
JP 2010-074625 A 4/2010
JP 2012-025545 2/2012

* cited by examiner

SHEET DISCHARGE DEVICE AND IMAGE FORMING APPARATUS INCLUDING THE SAME

CROSS-REFERENCE TO RELATED APPLICATIONS

This application claims priority under 35 U.S.C. § 119 (a) on Patent Application No. 2015-205734 filed in Japan on Oct. 19, 2015 and Patent Application No. 2016-149681 filed in Japan on Jul. 29, 2016, the entire contents of which are herein incorporated by reference.

Field of the Invention

The present invention relates to a sheet discharge device configured to discharge sheets such as recording sheets onto a discharge tray and to an image forming apparatus such as a copying machine, a multifunction machine, a printer and a facsimile machine, which includes the sheet discharge device.

Description of the Related Art

Conventionally, as the sheet discharge device for discharging sheets such as recording sheets onto the discharge tray, a device including a sheet sorting unit is known. The sheet sorting unit includes discharge rollers to transport a sheet in a predetermined transport direction and to discharge the sheet onto a discharge tray, and is configured to sort the sheet discharged from the discharge rollers by shifting the discharge rollers in the axial direction of the discharge rollers.

JP 2012-025545 A discloses a sheet discharge device including a sheet sorting unit, in which a sheet is transported in the transport direction by discharge rollers and is discharged by being shifted along the axial direction by the sheet sorting unit.

Also, a sheet discharge device is known, which includes an upper member disposed above a discharge tray with a space being interposed therebetween.

For example, JP 2005-075547 A discloses a configuration in which a sheet discharge unit (upper member) is disposed above a sheet discharge tray (discharge tray) with a space being interposed therebetween. Also, JP H10-017195 A discloses a configuration in which an additional sheet discharge tray (upper member) is disposed above an in-body discharge portion (discharge tray) with a space being interposed therebetween.

When the sheet is discharged from the sheet discharge device, sometimes the sheet is not discharged straightforwardly but discharged obliquely. Furthermore, when the sheet is thin, even when the sheet passes through the discharge rollers straightforwardly, the front edge of the sheet may be inclined obliquely relative to the discharge direction. In this case, there may occur a problem that the sheet is likely to be caught by a bottom face of the upper member.

The present invention was made in consideration of the above circumstances, and an object of which is to provide a sheet discharge device and an image forming apparatus in which a sheet can be smoothly discharged without being blocked by the upper member even when the sheet is discharged obliquely.

In the sheet discharge device that includes a sheet sorting unit and an upper member, when the sheet is transported in the transport direction by the discharge rollers and is discharged by being shifted along the axial direction by the sheet sorting unit, the sheet may make sliding contact with a bottom face of the upper member, the bottom face facing the discharge tray. In this case, there may occur a problem that the sheet, which is transported in the transport direction and discharged by being shifted along the axial direction, is likely to be caught by the bottom face of the upper member. For example, when protrusions (for example, reinforcing ribs) are disposed on the bottom face of the upper member, at least one of the following of the sheet is likely to be caught by the protrusions (for example, reinforcing ribs): a downstream side edge (front edge) in the sheet transport direction; a side edge in the axial direction; and a corner part of the front edge and the side edge (i.e., angle made by the two edges). Especially, the corner part of the front edge and the side edge is likely to be caught by the protrusions (reinforcing ribs).

Thus, the present invention is directed to a sheet discharge device and an image forming apparatus including the above, the sheet discharge device including: a sheet sorting unit that includes discharge rollers to transport a sheet in a predetermined transport direction and discharge the sheet onto a discharge tray, and that is configured to sort the sheet discharged from the discharge rollers by shifting the discharge rollers in the axial direction of the discharge rollers; and an upper member disposed above the discharge tray with a space being interposed therebetween. In this way, during transport of the sheet in the transport direction and discharge of the sheet by shifting along the axial direction, even when the sheet makes sliding contact with a bottom face of the upper member that faces the discharge tray, the sheet is hardly caught by the bottom face of the upper member.

SUMMARY OF THE INVENTION

A sheet discharge device according to the present invention includes: discharge rollers configured to transport a sheet in a predetermined transport direction and to discharge the sheet onto a discharge tray; and an upper member disposed above the discharge tray with a space being interposed therebetween. A bottom face of the upper member that faces the discharge tray includes a guide rib extending in an oblique direction inclined relative to the transport direction.

In the sheet discharge device according to the present invention, which may further include a sheet sorting unit configured to sort a sheet to be discharged by shifting the discharge rollers along an axial direction of the discharge rollers, the guide rib may extend in or substantially in a sheet oblique movement direction of the sheet being transported in the transport direction by the discharge rollers while being shifted along the axial direction by the sheet sorting unit.

In the sheet discharge device according to the present invention, which may further include the sheet sorting unit configured to sort a sheet to be discharged by shifting the discharge rollers along the axial direction of the discharge rollers, the guide rib may be located inside a side edge of the sheet in the axial direction, the sheet being transported in the transport direction by the discharge rollers while being shifted along the axial direction by the sheet sorting unit.

In the sheet discharge device according to the present invention, the guide rib may be disposed on at least one side edge portion out of both side edge portions of the bottom face of the upper member in the axial direction of the discharge rollers.

In the sheet discharge device according to the present invention, the guide rib may be inclined so as to be gradually higher from an upstream side to a downstream side in the transport direction relative to the bottom face of the upper member.

The sheet discharge device according to the present invention may include a plurality of the guide ribs.

In the sheet discharge device according to the present invention, the plurality of the guide ribs may include an inner guide rib and an outer guide rib in the axial direction of the discharge rollers. The inner guide rib may be formed shorter than the outer guide rib with a downstream side of the inner guide rib in the transport direction being maintained. The plurality of the guide ribs may be inclined so as to be gradually higher from the upstream side to the downstream side in the transport direction of the sheet relative to the bottom face of the upper member.

In the sheet discharge device according to the present invention, an inclination angle of an inclined face, which faces the discharge tray, of the inner guide rib relative to the bottom face of the upper member may be larger than an angle of a top face, which faces the discharge tray, of the outer guide rib relative to the bottom face of the upper member.

In the sheet discharge device according to the present invention, the inner guide rib may be constituted by a plurality of inclined rib parts connected to each other from the upstream side to the downstream side in the transport direction. An inclination angle of the inclined rib part on an upstream side may be larger than an inclination angle of the inclined rib part on a downstream side.

In the sheet discharge device according to present invention, a cross rib may be disposed on the bottom face of the upper member so as to extend along a direction intersecting with the guide rib. The guide rib may have a height higher than a height of the cross rib.

In the sheet discharge device according to the present invention, the cross rib may extend along an edge portion of a downstream side edge of the bottom face of the upper member in the transport direction.

In the sheet discharge device according to the present invention, an auxiliary rib may be disposed on the bottom face of the upper member so as to extend in a direction inclined relative to the transport direction and to be connected, with its edge, to the guide rib.

In the sheet discharge device according to the present invention, the guide rib may include a rib end part that is disposed on a downstream side by a predetermined distance from an upstream side edge in the transport direction, and that is in parallel or substantially in parallel with the transport direction.

In the sheet discharge device according to the present invention, the discharge rollers may be shifted to both of one side and another side in the axial direction. Out of the one side and the other side of the bottom face of the upper member with a center in the axial direction of the sheet being transported in the transport direction as a reference, the guide rib may be disposed on the side where an area of a predetermined sliding contact region of the bottom face of the upper member is larger than a predetermined reference area, the sliding contact region with which the sheet possibly makes sliding contact.

In the sheet discharge device according to the present invention, the guide rib may be formed so that a top part facing the discharge tray makes line contact or substantially line contact with the sheet when the sheet makes sliding contact with the guide rib.

An image forming apparatus according to the present invention includes the sheet discharge device according to the present invention.

With the present invention, even when the sheet makes sliding contact with the bottom face of the upper member, it is possible to prevent the sheet from being caught by the bottom face of the upper member.

DESCRIPTION OF THE PREFERRED EMBODIMENTS

Hereinafter, embodiments according to the present invention will be described with reference to the drawings.

(Description of Overall Configuration of Image Forming Apparatus)

Figure 1:
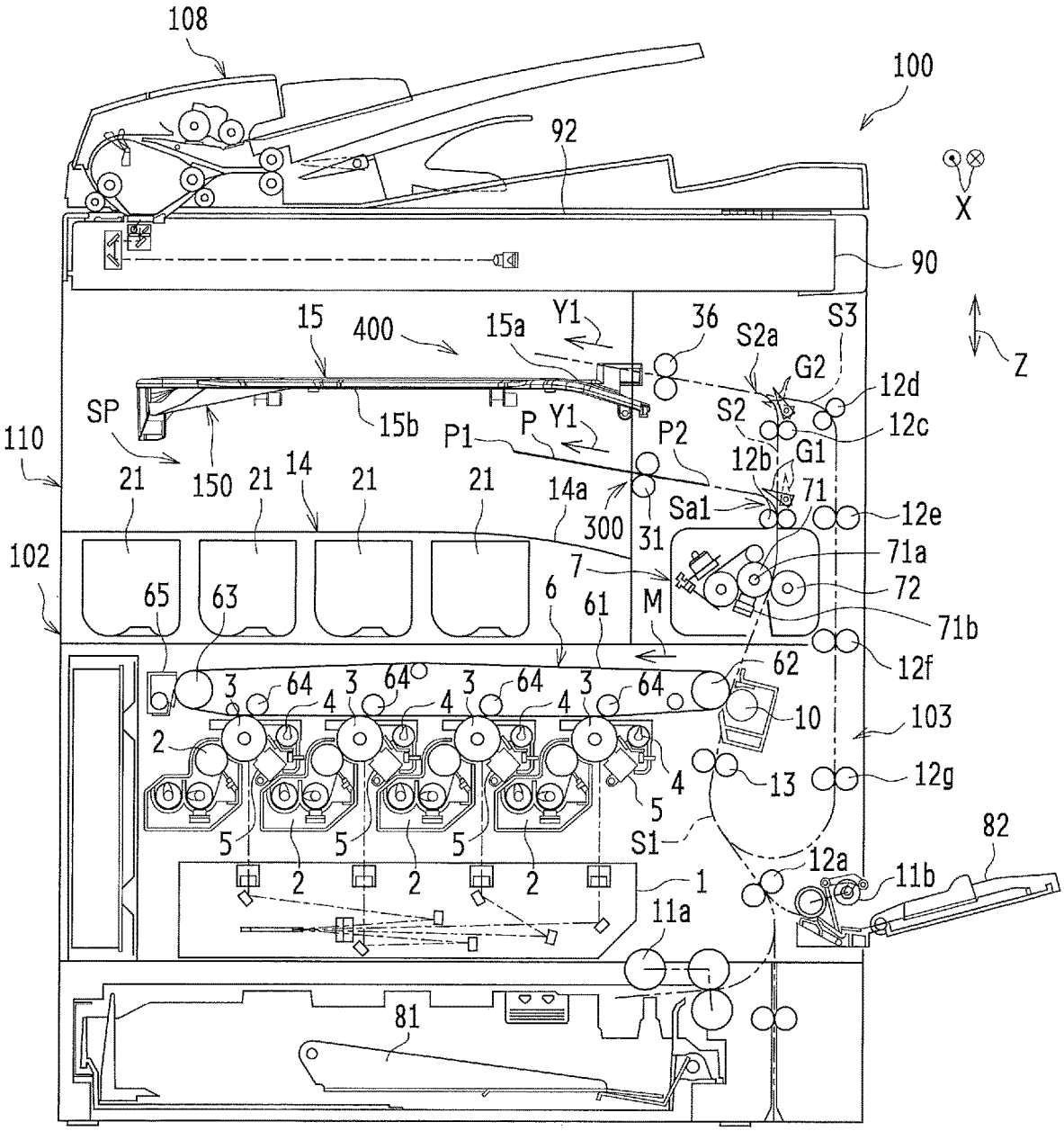
FIG. 1 is a schematic cross-sectional view of an image forming apparatus according to an embodiment of the present invention when viewed from the front.

FIG. 1 is a schematic cross-sectional view of an image forming apparatus 100 according to an embodiment of the present invention when viewed from the front.

The image forming apparatus 100 shown in FIG. 1 is a color image forming apparatus that forms multicolor and monochrome images on a sheet P such as a recording sheet (a recording sheet in this embodiment) in response to image data transmitted from the outside. The image forming apparatus 100 includes an original reading device 108 and an image forming apparatus main body 110. The image forming apparatus main body 110 includes an image forming unit 102 and a sheet transport mechanism 103. Specifically, the image forming apparatus 100 is a multifunction machine including a copy function, a printer function and a facsimile function.

The image forming unit 102 includes a light exposure unit 1, a plurality of development units 2, a plurality of photosensitive drums 3, a plurality of cleaning units 4, a plurality of charging units 5, an intermediate transfer belt unit 6, a plurality of toner cartridge units 21, and a fixing unit 7.

Furthermore, the sheet transport mechanism 103 includes a sheet feed tray 81, a manual sheet feed tray 82, a discharge tray 14 and a sheet discharge device 400.

The sheet discharge device 400 includes: a sheet sorting unit 300 that includes discharge rollers 31 to transport the sheet P in a predetermined transport direction Y1 and discharge the sheet P onto the discharge tray 14, and that sorts the sheet P discharged from the discharge rollers 31 by shifting the discharge rollers 31 in an axial direction X of the discharge rollers 31 (shift direction); and an upper discharge tray 15 (one example of the upper member) disposed above the discharge tray 14 with a space SP being interposed therebetween. The sheet discharge device 400 may include the discharge tray 14.

An original platen 92 made of transparent glass on which an original (not shown) is placed is disposed above the image forming apparatus main body 110. An optical unit 90 for reading the original is disposed under the original platen 92. The original reading device 108 is disposed above the original platen 92. The original reading device 108 transports automatically the original onto the original platen 92. The original reading device 108 is attached pivotally to the image forming apparatus main body 110 with the front side openable, and the original can be placed manually after exposing the surface of the original platen 92.

The original reading device 108 can read the original automatically transported or the original placed on the original platen 92. The image of the original read by the original reading device 108 is transmitted as image data to the image forming apparatus main body 110 of the image forming apparatus 100, and an image formed based on the image data in the image forming apparatus main body 110 is recorded on the sheet P.

The image data to be processed in the image forming apparatus 100 is that corresponding to color images using multiple colors (black (K), cyan (C), magenta (M) and yellow (Y) in this embodiment). Therefore, for each unit group of the development units 2, the photosensitive drums 3, the cleaning units 4, the charging units 5 and the toner cartridge units 21, a plurality of units (four in this embodiment, respectively corresponding to black, cyan, magenta and yellow) are provided, such that images of multiple kinds (four kinds in this embodiment) corresponding to four colors can be formed, and accordingly a plurality of image stations (four image stations in this embodiment) are configured.

The charging units 5 are charging means for uniformly charging the surface of photosensitive drums 3 to a predetermined potential, and for the charging units 5, contact type chargers such as roller type and brush type can be used, as well as the charger type as shown in FIG. 1.

The light exposure unit 1 is configured in a form of a laser scanning unit provided with a laser irradiating portion and reflection mirrors. The light exposure unit 1 is provided with a polygon mirror scanned by a laser beam, and optical elements such as lenses or mirrors for guiding the laser light reflected by the polygon mirror to the photosensitive drums 3.

The light exposure unit 1 irradiates the photosensitive drums 3 that are charged in accordance with input image data with light so that an electrostatic latent image in accordance with the image data is formed on each surface of the photosensitive drums 3.

The toner cartridge units 21 are units containing toner, and are configured to supply toner to the respective development tanks of the development units 2. In the image forming apparatus main body 110, the toner supplied from the toner cartridge units 21 to the respective development tanks of the development units 2 is controlled so that the toner concentration of a developer in each development tank is constant.

The development units 2 make the electrostatic latent images formed on the respective photosensitive drums 3 visible with four color toners (Y, M, C, and K). The cleaning units 4 remove and recover toner that remains on the respective surfaces of the photosensitive drums 3 that have undergone development and image transfer.

The intermediate transfer belt unit 6 disposed above the photosensitive drums 3 includes: an intermediate transfer belt 61 functioning as an intermediate transfer member; an intermediate transfer belt drive roller 62; an intermediate transfer belt driven roller 63; a plurality of intermediate transfer rollers 64; and an intermediate transfer belt cleaning unit 65.

As the intermediate transfer rollers 64, four rollers are disposed corresponding respectively to colors Y, M, C, and K. The intermediate transfer belt drive roller 62 supports the intermediate transfer belt 61 in cooperation with the intermediate transfer belt driven roller 63 and the intermediate transfer rollers 64 so that the intermediate transfer belt 61 is tensioned. When the intermediate transfer belt drive roller 62 is rotary driven, then the intermediate transfer belt 61 is orbited in a movement direction M, which causes the rotation of the intermediate transfer belt driven roller 63 and the intermediate transfer rollers 64.

A transfer bias is applied to the intermediate transfer rollers 64 for transferring respective toner images formed on the photosensitive drums 3 onto the intermediate transfer belt 61.

The intermediate transfer belt 61 is disposed in a manner making contact with each of the photosensitive drums 3. Toner images of the respective colors formed on the respective photosensitive drums 3 are sequentially transferred to the intermediate transfer belt 61 so as to be superimposed one after another, so that a color toner image (multicolor toner image) is formed on the surface of the intermediate transfer belt 61.

Toner images are transferred from the photosensitive drums 3 to the intermediate transfer belt 61 by the intermediate transfer rollers 64 that make contact with the back face of the intermediate transfer belt 61. A high voltage transfer bias (high voltage having an opposite polarity (+) to the polarity (−) of the charged toner) is applied to the intermediate transfer rollers 64 for transferring the toner images.

As described above, the toner images that are made visible in accordance with the respective color phases on the photosensitive drums 3 are layered on the intermediate transfer belt 61. The toner images layered on the intermediate transfer belt 61 are transferred onto the sheet P by a transfer roller 10 constructing a second transfer mechanism disposed in a contact position in which the sheet P makes contact with the intermediate transfer belt 61, by means of the orbital movement of the intermediate transfer belt 61.

At this time, a voltage (high voltage having an opposite polarity (+) of the polarity (−) of the charged toner) is applied to the transfer roller 10 so as to transfer the toner onto the sheet P in a state where a transfer nip portion is formed between the transfer roller 10 and the intermediate transfer belt 61. The transfer roller 10 and the intermediate transfer belt drive roller 62 are pressed against each other to form a transfer nip portion between the transfer roller 10 and the intermediate transfer belt 61. When transferring a toner image from the intermediate transfer belt 61 onto the sheet P with the transfer roller 10, the toner that has not been transferred onto the sheet P and remains on the intermediate transfer belt 61 is removed and recovered by the intermediate transfer belt cleaning unit 65.

The sheet feed tray 81 is a tray accommodating in advance the sheets P on which an image is to be formed (printed), and is disposed under the light exposure unit 1 in the image forming apparatus main body 110. On the manual sheet feed tray 82, the sheets P on which an image is to be formed (printed) are placed.

The discharge tray 14 is disposed above the image forming unit 102 in the image forming apparatus main body 110, and the sheet P on which an image has been formed (printed) is accumulated facedown on the discharge tray 14. The discharge tray 14 is configured such that the upstream side of a placing face 14*a* on which the sheet P is to be placed in the transport direction Y1 of the sheet P is lower than the downstream side. Although the configuration is not limited to the following, in this embodiment, the copying sheet P on which an image has been formed (printed) by the copying function and the printing sheet P on which an image has been formed (printed) by the printing function are discharged onto the discharge tray 14. Then, on the discharge tray 14, the copying sheet P and the printing sheet P are sorted by the sheet sorting unit 300.

Also, the upper discharge tray 15 is disposed above the discharge tray 14 of the image forming unit 102 in the image forming apparatus main body 110 with the space SP being interposed therebetween. The sheet P on which an image has been formed (printed) is accumulated facedown on the upper discharge tray 15. Similarly to the discharge tray 14, the upper discharge tray 15 is configured such that the upstream side of a placing face 15*a* on which the sheet P is to be placed in the transport direction Y1 of the sheet P is lower than the downstream side. Although the configuration is not limited to the following, in this embodiment, the facsimile sheet P on which an image has been formed (printed) by the facsimile function is discharged onto the upper discharge tray 15.

Furthermore, the image forming apparatus main body 110 is provided with: a sheet transport path S1 to guide the sheet P transported from the sheet feed tray 81 or the manual sheet feed tray 82 to the discharge tray 14 via the transfer roller 10 and the fixing unit 7; and an upper sheet transport path S2 that is branched upward from a branch section S1*a* located between the fixing unit 7 and the discharge rollers 31 on the sheet transport path S1 so as to guide the sheet P to the upper discharge tray 15. In the vicinity of the sheet transport path S1, the following are disposed: pickup rollers 11*a* and 11*b*; a plurality of (two in this embodiment) transport rollers 12*a* and 12*b*; registration rollers 13; the transfer roller 10; a heating roller 71 and a pressure roller 72 of the fixing unit 7; and the discharge rollers 31.

In the vicinity of the upper sheet transport path S2, upper transport rollers 12*c* and upper discharge rollers 36 are disposed. In the vicinity of the branch section S1*a*, a branch claw G1 is disposed. The branch claw G1 is switched to a first switching position (position indicated by the solid line in FIG. 1) to guide the sheet P from the fixing unit 7 to the discharge rollers 31 and a second switching position (position indicated by the imaginary line in FIG. 1) to guide the sheet P from the fixing unit 7 to the upper sheet transport path S2.

The upper discharge rollers 36 are rotated in the forward direction to discharge the sheet P onto the upper discharge tray 15, while they are rotated in the reverse direction to transport the sheet P in the direction opposite to the transport direction Y1 (i.e., switchback). The image forming apparatus main body 110 is provided with a reverse sheet transport path S3 to guide the sheet P to the upstream side of the registration roller 13 of the sheet transport path S1 so that the front and the back of the sheet P are reversed from an upper branch section S2*a* located on the way of the upper sheet transport path S2.

In the vicinity of the reverse sheet transport path S3, a plurality of (four in this embodiment) reverse transport rollers 12*d* to 12*g* is disposed. In the vicinity of the upper branch section S2*a*, an upper branch claw G2 is disposed. The upper branch claw G2 is switched to a first switching position (position indicated by the solid line in FIG. 1) to guide the sheet P from the branch section S1*a* to the upper discharge rollers 36 and a second switching position (position indicated by the imaginary line in FIG. 1) to guide the sheet P switched back from the upper discharge rollers 36 to the reverse sheet transport path S3.

The transport rollers 12*a* and 12*b*, the upper transport rollers 12*c* and the reverse transport rollers 12*d* to 12*g* are small rollers that promote and assist transport of the sheet P, and are disposed, respectively, along the sheet transport path S1, the upper sheet transport path S2 and the reverse sheet transport path S3.

The pickup roller 11*a* is disposed in the vicinity of the sheet feed tray 81 on the sheet feeding side, and picks the sheet P up, sheet by sheet, from the sheet feed tray 81 to feed the sheet P to the sheet transport path S1. Similarly, the pickup roller 11*b* is disposed in the vicinity of the manual sheet feed tray 82 on the sheet feeding side, and picks the sheet P up, sheet by sheet, from the manual sheet feed tray 82 to feed the sheet P to the sheet transport path S1.

The registration rollers 13 temporarily hold the sheet P transported to the sheet transport path S1. Then, the registration rollers 13 transport the sheet P to the transfer nip portion between the transfer roller 10 and the intermediate transfer belt 61 at a timing at which a front edge of the toner image on the photosensitive drums 3 is aligned with a downstream side edge (sheet front edge P1) of the sheet P in the transport direction Y1.

The fixing unit 7 fixes an unfixed toner image onto the sheet P, which includes the heating roller 71 and the pressure roller 72 that function as fixing rollers. By being driven to rotate, the heating roller 71 transports the sheet P while sandwiching the sheet P along with the pressure roller 72 that is rotated following the rotation of the heating roller 71. The heating roller 71 is heated by a heater 71*a* disposed therein, and is maintained at a predetermined fixing temperature based on a signal from a temperature detector 71*b*. The heating roller 71 heated by the heater 71*a* performs thermo-compression bonding of a multicolor toner image on the sheet P along with the pressure roller 72, the multicolor toner image having been transferred onto the sheet P. Thus, the multicolor toner image is melted, mixed and pressed, thereby thermo-fixed onto the sheet P.

In the image forming apparatus 100 configured as described above, when the printing by the copying function or the printing function is required, at first the branch claw G1 is switched to the first position. When the printing by the facsimile function is required, the branch claw G1 is switched to the second position while the upper branch claw G2 is switched to the first position. Then, the sheet P is fed from the sheet feed tray 81 or the manual sheet feed tray 82 so that the sheet P is transported to the registration rollers 13 by the transport rollers 12*a* disposed along the sheet transport path S1. The sheet P is transported by the transfer roller 10 at the timing at which the sheet front edge P1 of the sheet P and the front edge of the toner image on the intermediate transfer belt 61 are aligned with each other, thus, the toner image is transferred onto the sheet P. After that, the sheet P is caused to pass through the fixing unit 7 so that the unfixed toner on the sheet P is melted and fixed by the heat. Thus, in case of request of the printing by the copying function or the printing function, the sheet P is discharged onto the discharge tray 14 via the transport rollers 12*b*, the branch claw G1 and the discharge rollers 31. In case of request of the printing by the facsimile function, the sheet P is discharged onto the upper discharge tray 15 via the transport rollers 12*b*, the branch claw G1, the upper branch claw G2 and the upper discharge rollers 36.

Also, when the duplex printing on the sheet P is required, the branch claw G1 is once switched to the second position while the upper branch claw G2 is switched to the first position. Then, the sheet P is caused to pass through the fixing unit 7, and after the simplex printing is completed, the upper discharge rollers 36 are rotated in the reverse direction in a state in which the upstream side edge (sheet rear edge P2) of the sheet P in the transport direction Y1 is positioned between the upper discharge rollers 36 and the upper branch section S2*a* of the upper sheet transport path S2, so that the sheet P is guided to the reverse transport rollers 12*d* to 12*g*. Then, when the printing by the copying function or the printing function is required, the branch claw G1 is switched to the first position. When the printing by the facsimile function is required, the branch claw G1 is switched to the second position while the upper branch claw G2 is switched to the first position. After that, the sheet P is transported to the transfer nip portion via the registration rollers 13 to form an image on the back face of the sheet P. Thus, in case of request of the printing by the copying function or the printing function, the sheet P is discharged onto the discharge tray 14. In case of request of the printing by the facsimile function, the sheet P is discharged onto the upper discharge tray 15.

Next, the sheet sorting unit 300 will be described below with reference to FIGS. 2 and 3. The elements that have the reference numerals of FIG. 1 and that are not described yet will be described later.

(Sheet Sorting Unit)

Figure 2:
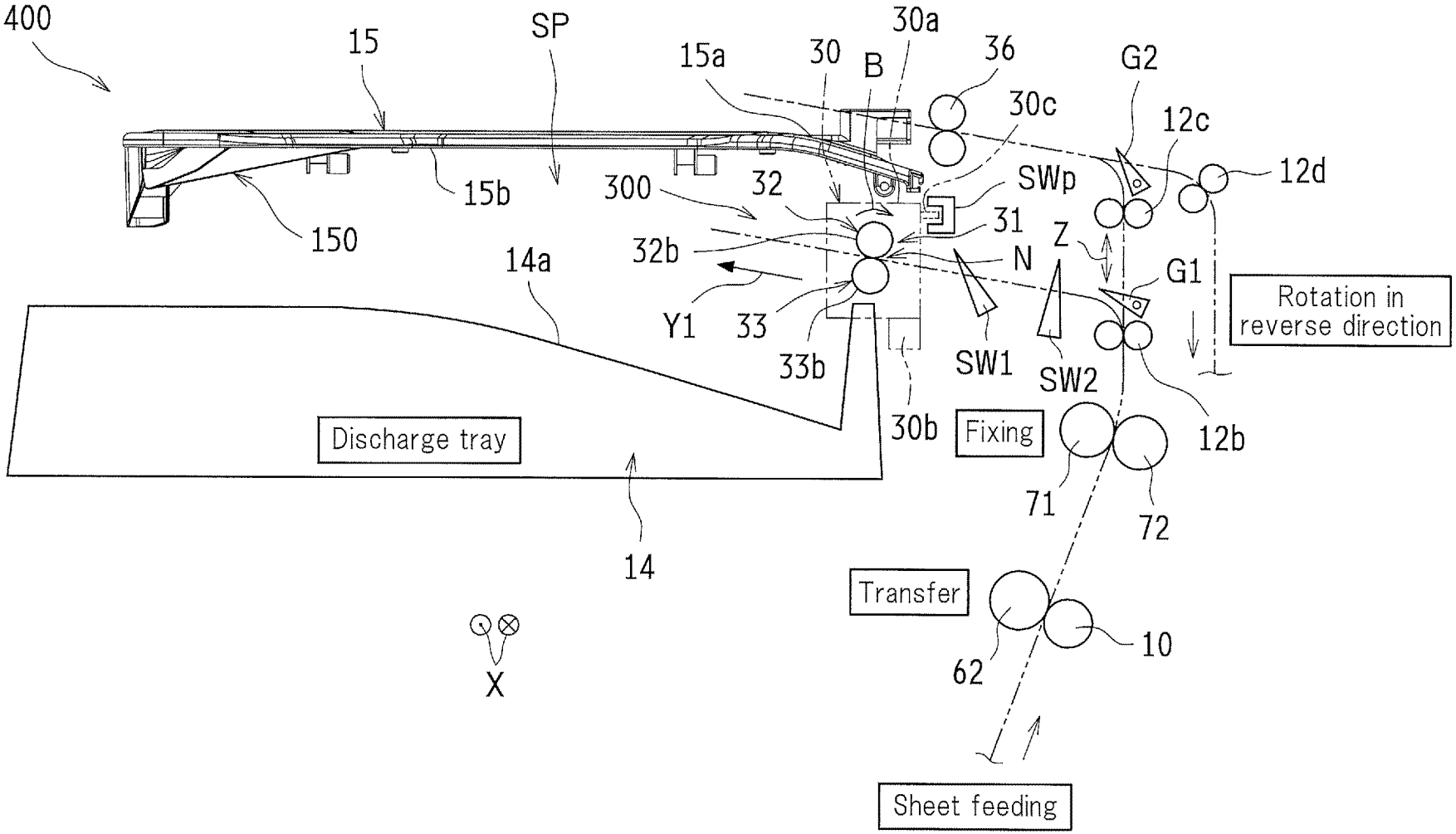
FIG. 2 is a schematic cross-sectional view showing discharge rollers and the vicinity thereof in the image forming apparatus in FIG. 1.

FIG. 2 is a schematic cross-sectional view showing the discharge rollers 31 and the vicinity thereof in the image forming apparatus 100 in FIG. 1. FIG. 3 is a schematic side view showing the sheet sorting unit 300 in the image forming apparatus 100 in FIG. 1 when viewed in the transport direction Y1 of the sheet P.

Figure 3:
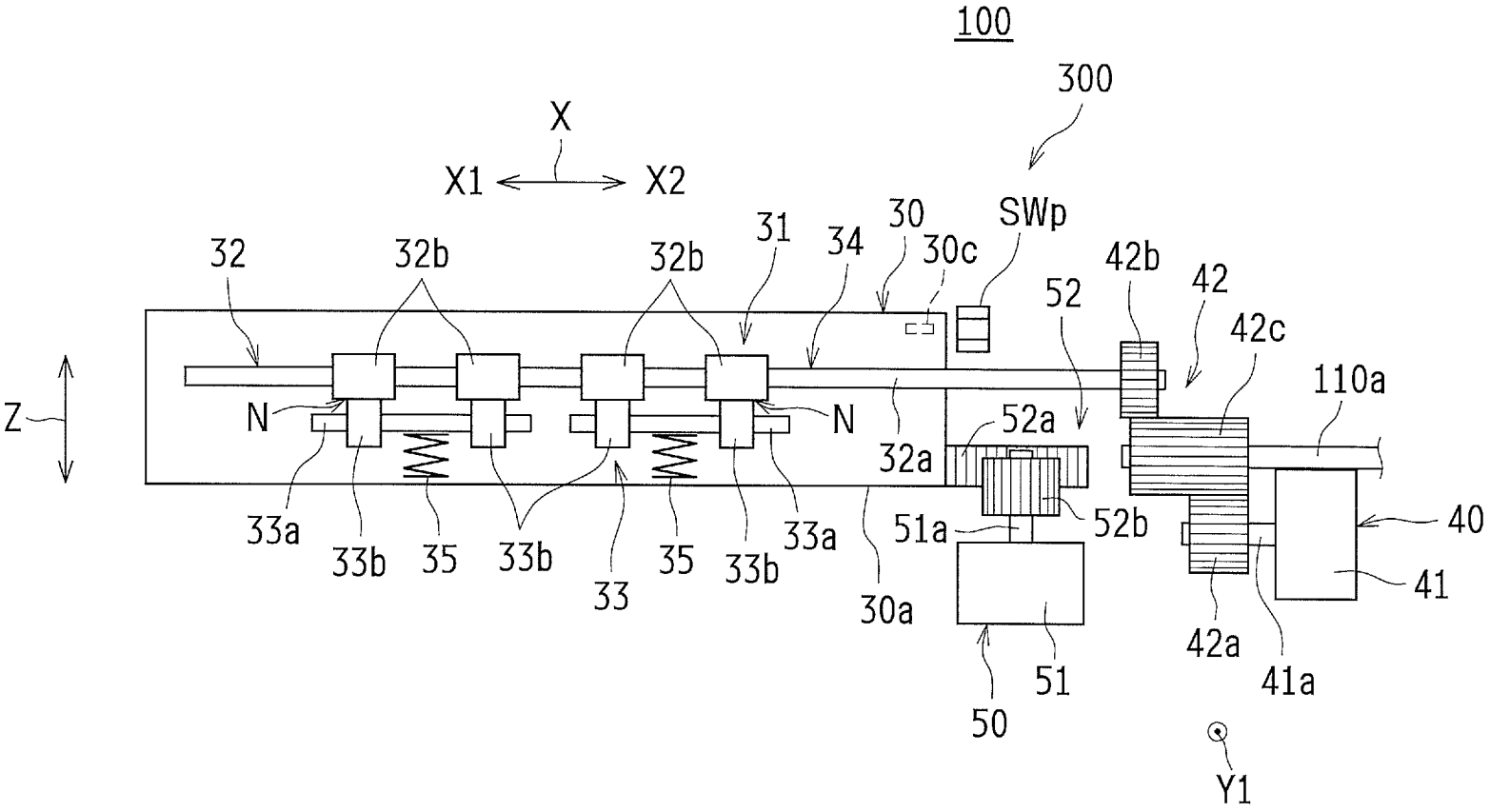
FIG. 3 is a schematic side view showing a sheet sorting unit in the image forming apparatus in FIG. 1 when viewed in a sheet transport direction.

As shown in FIGS. 2 and 3, the sheet sorting unit 300 is provided with: a discharge roller shift unit 30 having the discharge rollers 31; a rotation drive unit 40 (see FIG. 3); and a shift drive unit 50 (see FIG. 3).

The discharge roller shift unit 30 is disposed reciprocally movably along the axial direction X of the discharge rollers 31 relative to the image forming apparatus main body 110. Specifically, the discharge roller shift unit 30 is supported by the image forming apparatus main body 110 via a slide member 30*b* (specifically, slide rail, see FIG. 2) reciprocally movable along the axial direction X. Since the slide member 30*b* can have a configuration conventionally known, the detail description thereon is omitted here.

Also, on a main body frame 30*a* of the discharge roller shift unit 30, a detection object 30*c* (specifically, detection piece) is disposed so as to be detected by a position detection switch SWp described later.

The discharge rollers 31 discharge the sheet P onto the discharge tray 14, and specifically, they are a pair of discharge rollers 34 (see FIG. 3) constituted by a discharge drive roller 32 and a discharge driven roller 33.

Specifically, the discharge drive roller 32 includes: a drive roller shaft 32*a* (see FIG. 3); and a plurality of (four in this embodiment) drive roller units 32*b* disposed so as to be fixed on the same axis of the drive roller shaft 32*a*. The discharge driven roller 33 includes: driven roller shafts 33*a* (see FIG. 3); and a plurality of (four in this embodiment) driven roller units 33*b* disposed so as to be fixed on the same axis of the driven roller shafts 33*a* and to face the respective drive roller units 32*b*. Also, the discharge rollers 31 further include biasing members (coil springs in this embodiment) 35 (see FIG. 3) that bias the driven roller units 33*b* toward the drive roller units 32*b*.

The pair of discharge rollers 34 and the biasing members 35 are disposed in the main body frame 30*a* of the discharge roller shift unit 30. One end portion of the discharge drive roller 32 is protruded from the main body frame 30*a* of the discharge roller shift unit 30 to the outside in the axial direction X.

Specifically, the drive roller shaft 32*a* of the discharge drive roller 32 is a single shaft that is disposed rotatably about its axis line in the main body frame 30*a* of the discharge roller shift unit 30.

A plurality of (two in this embodiment) driven roller shafts 33*a* of the discharge driven roller 33 is arranged side by side along the axial direction X, and on each of the driven roller shafts 33*a*, a plurality of (two in this embodiment) driven roller units 33*b* are disposed so as to be fixed. The driven roller shafts 33*a* are rotatable about their axis line and reciprocally movable in a vertical direction Z, in the main body frame 30*a* of the discharge roller shift unit 30, so that the driven roller units 33*b* face the respective drive roller units 32*b*. In the discharge rollers 31, the sheet P is sandwiched by a nip portion N between the discharge drive roller 32 and the discharge driven roller 33 in a state in which the sheet P is pressed by the discharge driven roller 33 while being transported.

A plurality of (two in this embodiment) biasing members 35 are provided respectively corresponding to the plurality of (two in this embodiment) driven roller shafts 33*a*. The biasing members 35 bias the discharge driven roller 33 toward the discharge drive roller 32. The biasing members 35 are disposed between the driven roller shafts 33*a* and a position of the main body frame 30*a* of the discharge roller shift unit 30, the position opposite to the discharge drive roller 32. A pressing force of the discharge driven roller 33 by the biasing members 35 against the discharge drive roller 32 is a force to appropriately transport the sheet P.

The rotation drive unit 40 drives and rotates the discharge rollers 31, and includes a transport drive motor 41 (stepping motor in this embodiment, see FIG. 3) and a drive transmission mechanism 42 (see FIG. 3) to transmit rotation drive from the transport drive motor 41 to the discharge rollers 31.

The transport drive motor 41 is disposed in the image forming apparatus main body 110 so that a rotating shaft 41*a* is along the axial direction X.

In this embodiment, the drive transmission mechanism 42 is constituted by a gear train in which a plurality of gears is lined up. Specifically, the drive transmission mechanism 42 includes a drive gear 42*a*, a roller gear 42*b* and an intermediate gear 42*c*.

The drive gear 42*a* is coupled to the rotating shaft 41*a* of the transport drive motor 41. The roller gear 42*b* is coupled to the end portion of the drive roller shaft 32*a* protruded from the main body frame 30*a* of the discharge roller shift unit 30 to the outside in the axial direction X. The intermediate gear 42*c* is rotatably supported by a rotating shaft 110*a* fixed to the image forming apparatus main body 110, and is meshed with the drive gear 42*a* and the roller gear 42*b*. Here, the drive gear 42*a*, the roller gear 42*b* and the intermediate gear 42*c* are spur gears respectively having gear teeth formed in a concave-convex shape extending in the axial direction X. The roller gear 42*b* and the intermediate gear 42*c* can be slid in the axial direction X while they are meshed with each other. The length of the intermediate gear 42*c* in the axial direction X is made to allow a width of movement of the discharge roller shift unit 30 in the axial direction X (i.e., length obtained by adding a length corresponding to the shift amount to the mesh length of the gears). That is, with this length, the roller gear 42*b* is not disengaged from the intermediate gear 42*c* even when the discharge roller shift unit 30 is moved reciprocally in the axial direction X.

The shift drive unit 50 drives the discharge rollers 31 (discharge roller shift unit 30 in this embodiment) to be shifted, and includes a shift drive motor 51 (stepping motor in this embodiment, see FIG. 3) and a shift mechanism 52 (see FIG. 3) to shift the discharge roller shift unit 30.

The shift drive motor 51 is disposed in the image forming apparatus main body 110 so that a rotating shaft 51*a* is along a direction orthogonal to the axial direction X (vertical direction Z in this embodiment).

The shift mechanism 52 is constituted by rack and pinion gears that convert a rotation direction drive into a straight line direction drive, and includes a rack gear 52*a* extending in the axial direction X and a columnar-shaped pinion gear 52*b*.

An end portion of the rack gear 52*a* in the axial direction X is coupled to the end part of the discharge roller shift unit 30. The pinion gear 52*b* is coupled to the rotating shaft 51*a* of the shift drive motor 51, and is meshed with the rack gear 52*a*. Thus, by rotation of the rotating shaft 51*a* of the shift drive motor 51 in one direction or the other direction, it is possible to reciprocally move the discharge roller shift unit 30 to one side X1 or the other side X2 in the axial direction X.

Next, a control unit 200 will be described with reference to FIG. 4 below. The elements that have the reference numerals of FIG. 2 and that are not described yet will be described later.

(Control Unit)

Figure 4:
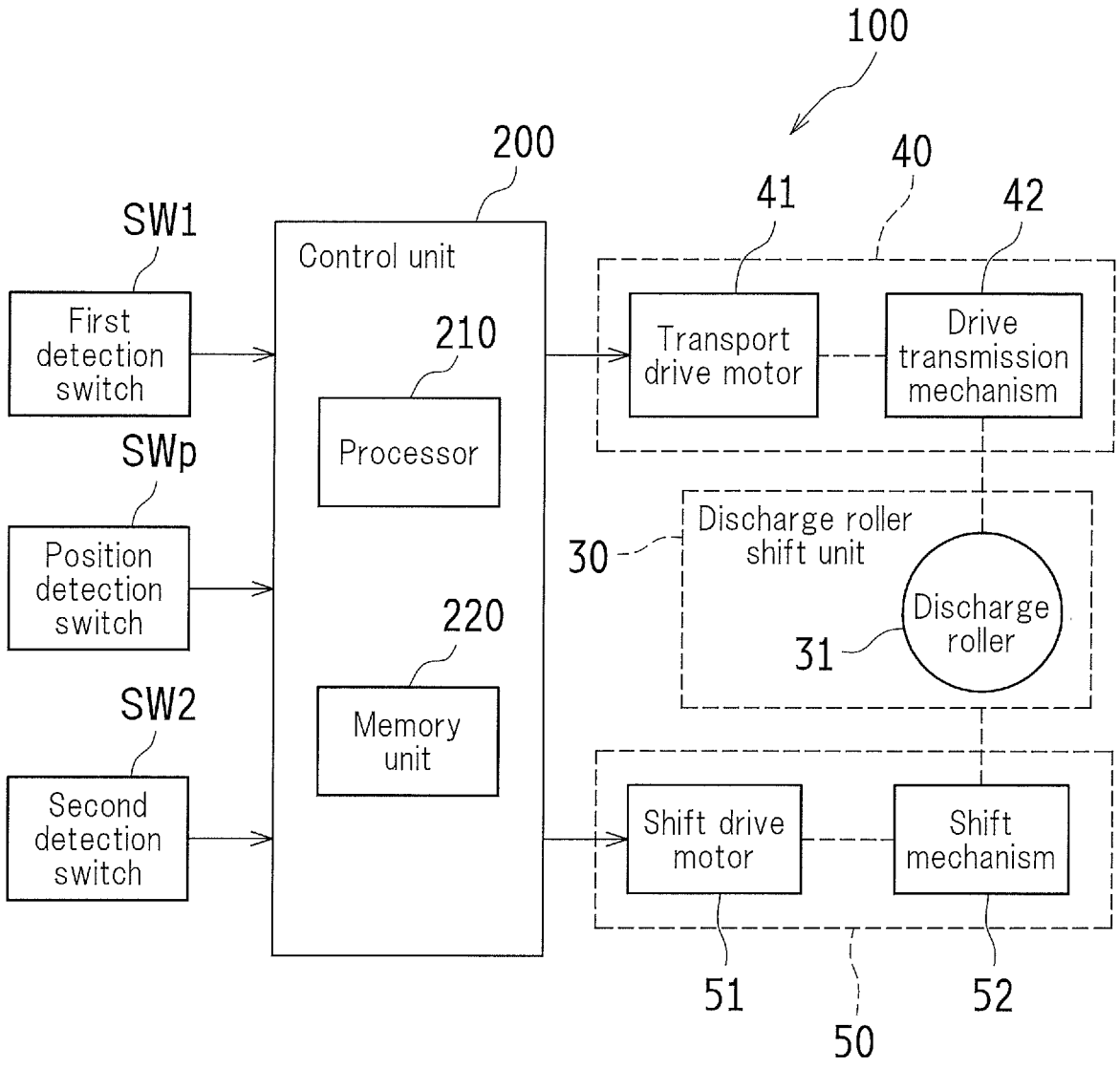
FIG. 4 is a system block diagram of a control system of the image forming apparatus in FIG. 1.

FIG. 4 is a system block diagram of a control system of the image forming apparatus 100 in FIG. 1. The image forming apparatus 100 further includes: the control unit 200; a first detection switch SW1 (see FIGS. 2 and 4); a second detection switch SW2 (see FIGS. 2 and 4); and the position detection switch SWp (see FIGS. 2 to 4). The sheet discharge device 400 may include the control unit 200.

As shown in FIG. 4, a control unit 200 includes: a processor 210 such as a CPU; and a memory unit 220 including a ROM (read only memory), a RAM (random access memory) and a non-volatile rewritable memory. The ROM can store a control program indicating a procedure of processing to be performed by the processor 210. The RAM can provide a work area. The non-volatile memory can back up and hold data necessary to control, or can hold or rewrite various types of data (for example, control time period for timing control described later).

The control unit 200 performs timing control of the rotation drive unit 40 and the shift drive unit 50, as timing control of the sheet sorting unit 300 of the image forming apparatus 100.

The first detection switch SW1 detects whether the sheet P is passing through the discharge rollers 31. Specifically, the first detection switch SW1 is disposed in the vicinity of the upstream side of the discharge rollers 31 in the transport direction Y1. The first detection switch SW1 is electrically connected to an input system of the control unit 200 so that a sheet non-passing signal (Off signal in this embodiment) indicating that the sheet P is not passing through the discharge rollers 31 or a sheet passing signal (On signal in this embodiment) indicating that the sheet P is passing through the discharge rollers 31 can be transmitted to the control unit 200.

The second detection switch SW2 detects whether the sheet P is passing through closest rollers (transport rollers 12*b* in this embodiment) disposed closest to the second detection switch SW2 on the upstream side of the discharge rollers 31 in the transport direction Y1. Specifically, the second detection switch SW2 is disposed in the vicinity of the closest rollers (transport rollers 12*b* in this embodiment) on the downstream side in the transport direction Y1. The second detection switch SW2 is electrically connected to the input system of the control unit 200 so that the sheet non-passing signal (Off signal in this embodiment) indicating that the sheet P is not passing through the closest rollers (transport rollers 12*b* in this embodiment) or the sheet passing signal (On signal in this embodiment) indicating that the sheet P is passing through the closest rollers (transport rollers 12*b* in this embodiment) can be transmitted to the control unit 200.

The position detection switch SWp detects whether the discharge roller shift unit 30 is located at a reference position (specifically, a center position in the axial direction X, i.e., a standard position at which no sorting is performed). In particular, the position detection switch SWp is a transmission-type optical sensor that detects the detection object 30*c* (see FIGS. 2 and 3) disposed in the main body frame 30*a* of the discharge roller shift unit 30. The position detection switch SWp is electrically connected to the input system of the control unit 200 so that a unit presence signal (Off signal in this embodiment) indicating that the discharge roller shift unit 30 is located at the reference position or a unit absence signal (On signal in this embodiment) indicating that the discharge roller shift unit 30 is not located at the reference position can be transmitted to the control unit 200.

The transport drive motor 41 and the shift drive motor 51 are electrically connected to an output system of the control unit 200 so that a drive signal (On signal) or a drive stop signal (Off signal) from the control unit 200 can be obtained.

Specifically, the control unit 200 transmits, to the transport drive motor 41, a rotation instruction signal to instruct the motor to rotate in one direction B (direction in which the sheet P is discharged, see FIG. 2) so as to drive the transport drive motor 41. Thus, the discharge roller 31 of the discharge roller shift unit 30 is driven to rotate in the one direction B via the drive transmission mechanism 42.

Also, the control portion 200 transmits, to the shift drive motor 51, a movement instruction signal to instruct the motor to rotate to move the discharge roller shift unit 30 toward the one side X1 in the axial direction X (a left direction in the example shown in FIG. 3) relative to the reference position and to rotate to move the discharge roller shift unit 30 toward the other side X2 in the axial direction X (a right direction in the example shown in FIG. 3) relative to the reference position so that the shift drive motor 51 is pulse-driven. Thus, the discharge roller shift unit 30 is driven to shift to the one side X1 and to the other side X2 via the shift mechanism 52.

In the sheet sorting unit 300 as described above, the transport drive motor 41 is driven in response to the rotation instruction signal from the control unit 200 to transmit the drive force from the transport drive motor 41 to the drive transmission mechanism 42. Thus, the discharge rollers 31 are rotated in the one direction B. When the sorting operation is not performed, the discharge roller shift unit 30 is located at the reference position. On the other hand, when the sorting operation is performed, the sheet P is transported in only the transport direction Y1 by the predetermined distance by the discharge rollers 31 in a state in which the discharge roller shift unit 30 is being located at the reference position. After that, the shift drive motor 51 is driven in response to the movement instruction signal from the control unit 200 to transmit the drive force from the shift drive motor 51 to the shift mechanism 52. Thus, the discharge roller shift unit 30 is shifted to the one side X1 or the other side X2. In this way, in the sheet discharge device 400 including the sheet sorting unit 300, the sheet P is transported by the discharge rollers 31 in the transport direction Y1 while being shifted along the one side X1 and/or the other side X2 in the axial direction X (in this embodiment, along the one side X1 and the other side X2 in the axial direction X) by the sheet sorting unit 300 so as to be discharged onto the discharge tray 14. In the sheet sorting unit 300, the discharge roller shift unit 30 may be shifted to the one side X1 or the other side X2 without the sheet P being transported only in the transport direction Y1.

Next, a guide rib 150 (see FIGS. 1 and 2) disposed on the upper discharge tray 15 shown in FIGS. 1 and 2 will be described hereinafter.

Embodiments of the Invention

When the sheet discharge device 400 includes the sheet sorting unit 300 and the upper discharge tray 15 (one example of the upper member) as shown in this embodiment, the sheet P is shifted along the axial direction X by the sheet sorting unit 300 so as to be discharged while being transported in the transport direction Y1 by the discharge rollers 31. In this configuration, the sheet P, which is shifted along the axial direction X to be discharged while being transported in the transport direction Y1, is likely to be caught by a bottom face 15*b* of the upper discharge tray 15 when it makes sliding contact with the bottom face 15*b* facing the discharge tray 14 (i.e., undersurface, the face on the side of the discharge tray 14, see FIGS. 1 and 2).

Figure 5:
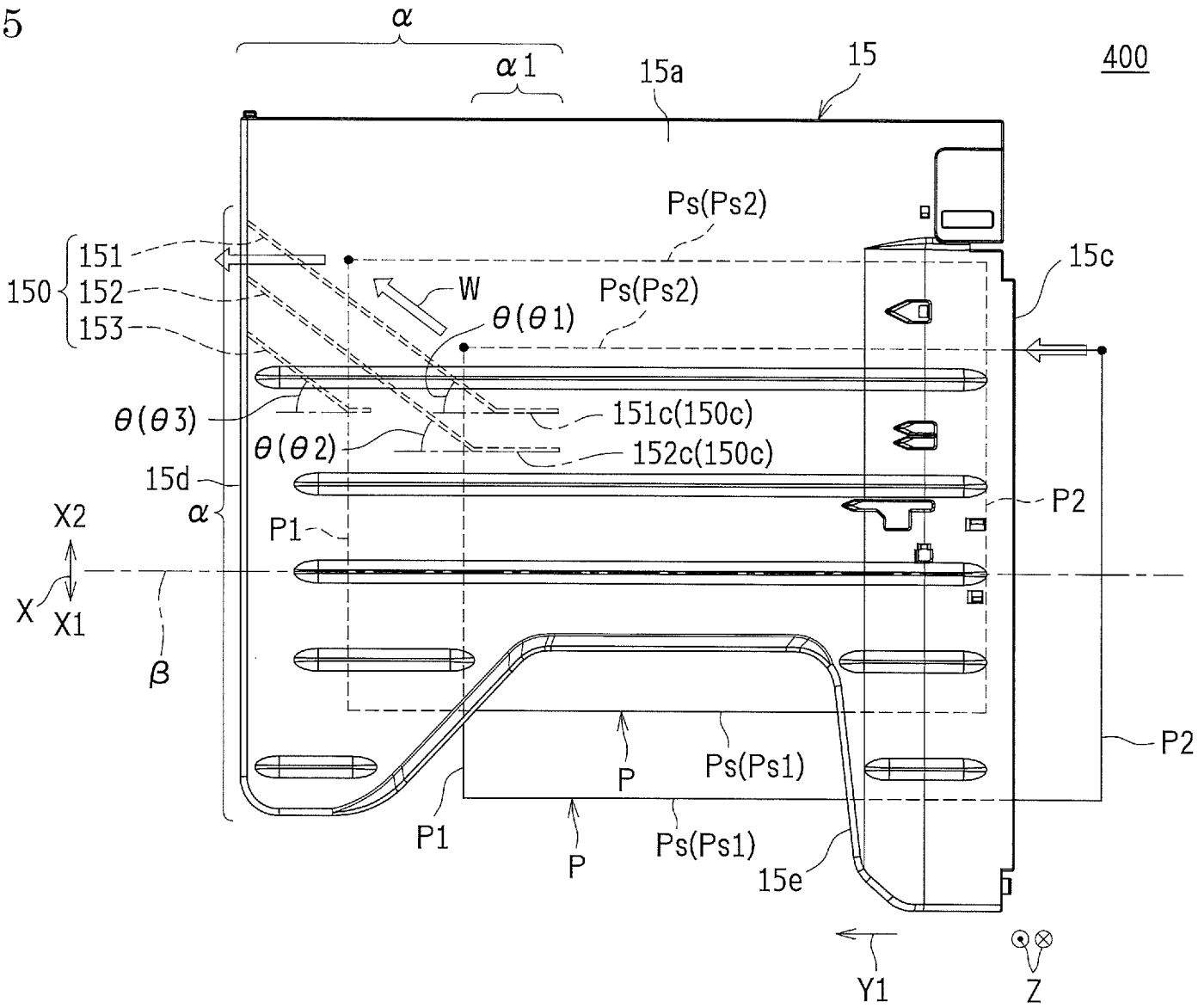
FIG. 5 is a schematic plan view showing a state in which a sheet is discharged under an upper discharge tray in the sheet discharge device according to the embodiment of the present invention when viewed in a plan view.
Figure 6:
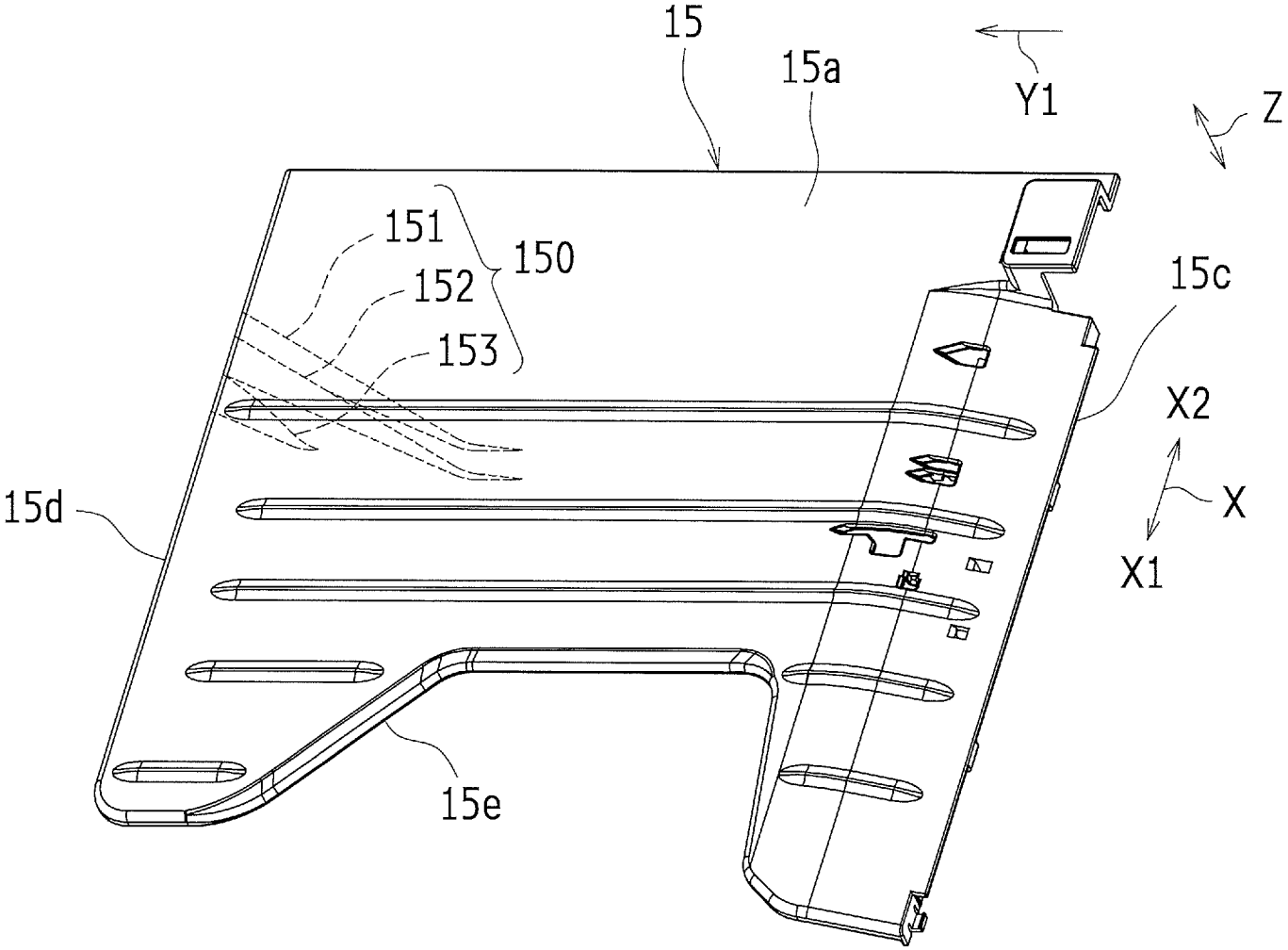
FIG. 6 is a schematic perspective view of a plane of the upper discharge tray in FIG. 5 when viewed from a diagonally forward right side.
Figure 7:
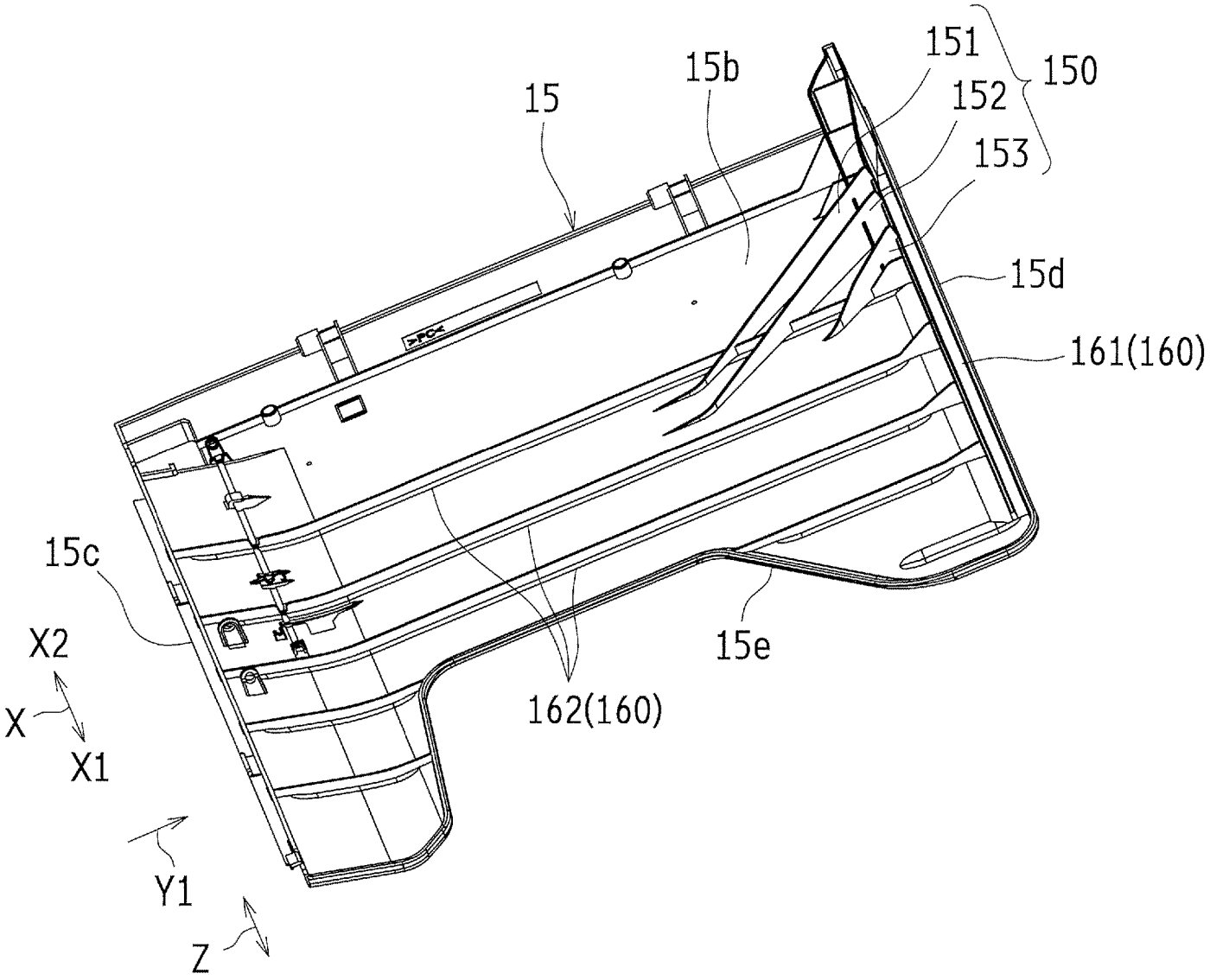
FIG. 7 is a schematic perspective view of a bottom face of the upper discharge tray in FIG. 5 when viewed from a diagonally forward left side.
Figure 8A:
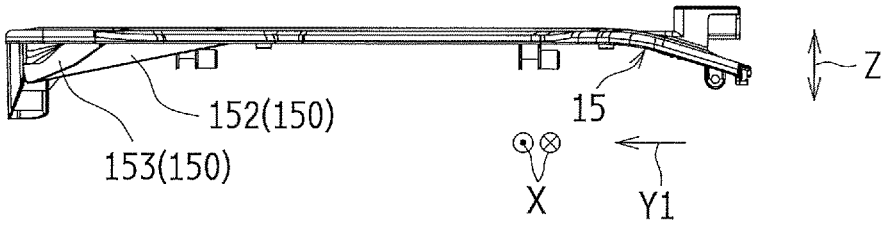
FIG. 8A is a front view of a schematic configuration of the upper discharge tray in FIG. 5.
Figure 8B:
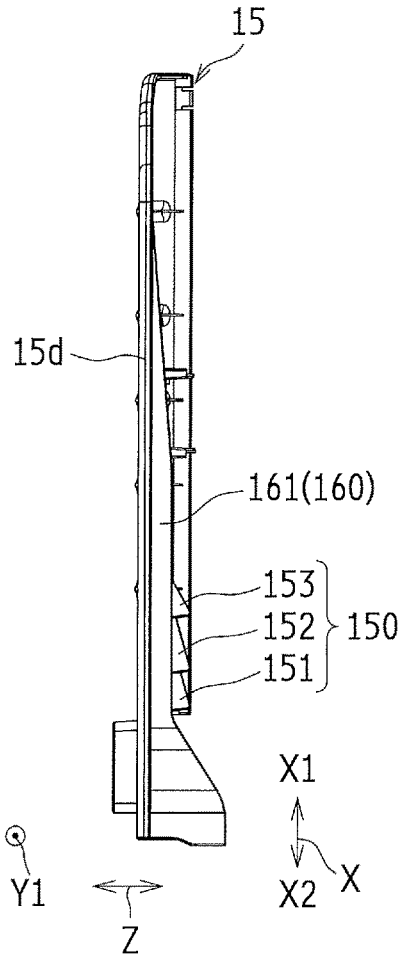
FIG. 8B is a left side view of the schematic configuration of the upper discharge tray in FIG. 5.
Figure 8C:
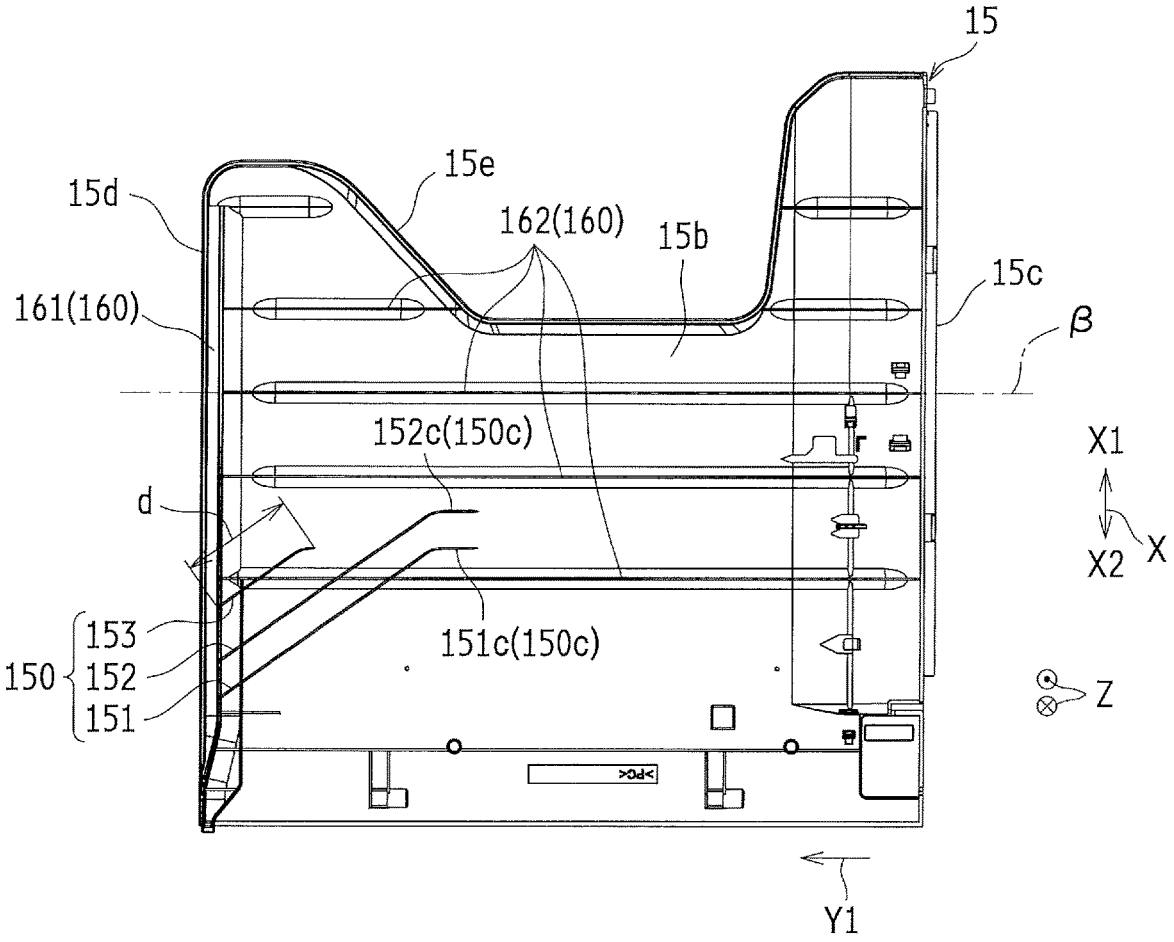
FIG. 8C is a bottom view of the schematic configuration of the upper discharge tray in FIG. 5.
Figure 9:
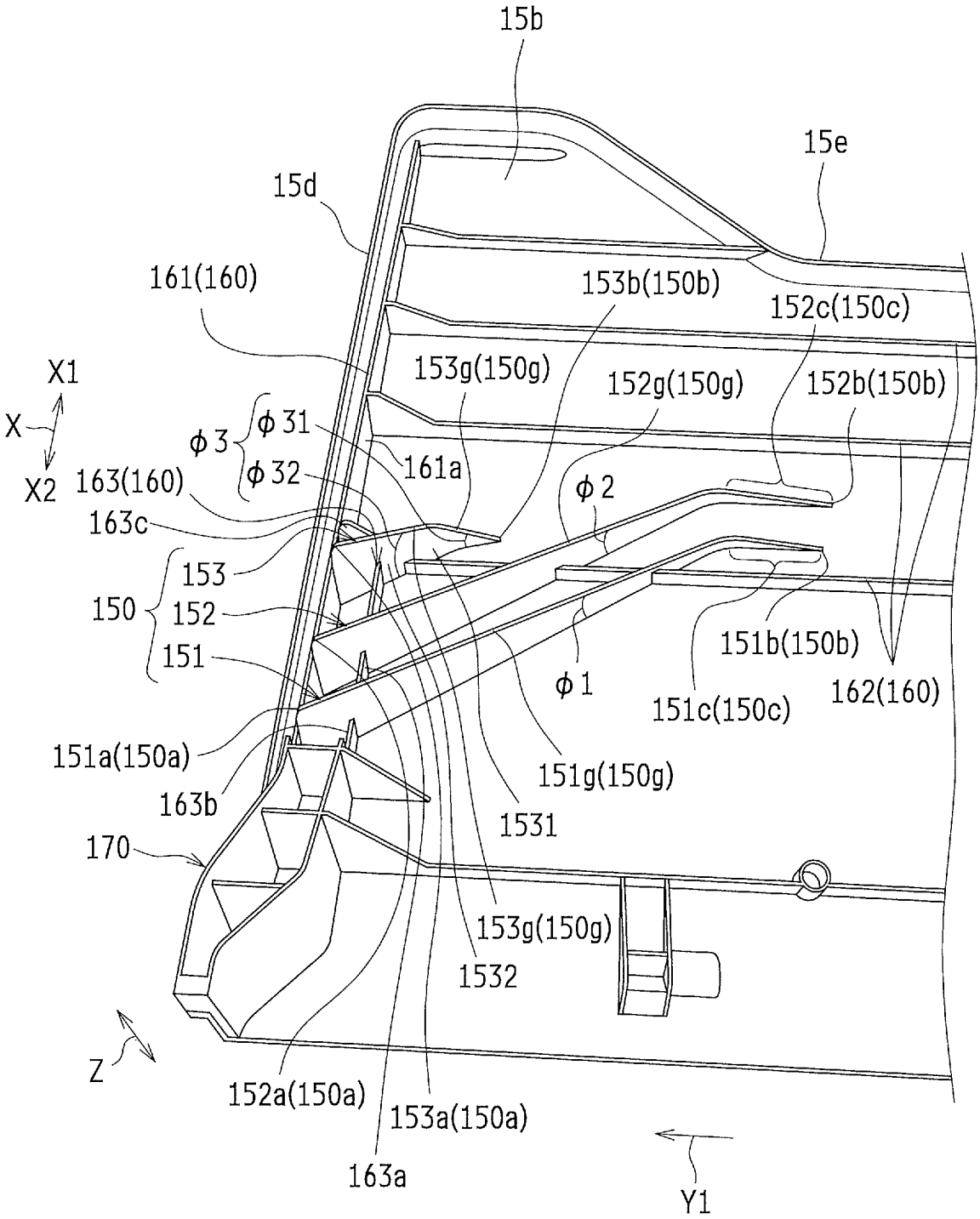
FIG. 9 is an enlarged perspective view showing a guide rib of the bottom face of the upper discharge tray in FIG. 5 when viewed from a diagonally backward right side.

FIG. 5 is a schematic plan view showing a state in which the sheet P is discharged under the upper discharge tray 15 in the sheet discharge device 400 according to this embodiment when viewed in a plan view. FIG. 6 is a schematic perspective view of a plane of the upper discharge tray 15 in FIG. 5 when viewed from a diagonally forward right side. FIG. 7 is a schematic perspective view of a bottom face of the upper discharge tray 15 in FIG. 5 when viewed from a diagonally forward left side. FIG. 8A is a front view of a schematic configuration of the upper discharge tray 15 in FIG. 5. FIG. 8B is a left side view of the schematic configuration of the upper discharge tray 15 in FIG. 5. FIG. 8C is a bottom view of the schematic configuration of the upper discharge tray 15 in FIG. 5. FIG. 9 is an enlarged perspective view showing the guide rib 150 of the bottom face of the upper discharge tray 15 in FIG. 5 when viewed from a diagonally backward right side.

In this embodiment, on the bottom face 15*b* of the upper discharge tray 15 (see FIGS. 7, 8C and 9), the guide rib 150 is disposed so as to extend in the oblique direction inclined to the shift movement side relative to the transport direction Y1. Specifically, the guide rib 150 is disposed on the bottom face 15*b* of the upper discharge tray 15 so that its downstream side extends in the oblique direction inclined to the shift movement side relative to the transport direction Y1, the guide rib 150 being disposed within and/or so as to extend across a predetermined sliding contact region α (see FIG. 5) with which the sheet P could make sliding contact.

Here, the sliding contact region α means a region where the sheet P, which is shifted along the axial direction X by the sheet sorting unit 300 while being transported in the transport direction Y1 by the discharge rollers 31, possibly makes sliding contact with the bottom face 15*b* of the upper discharge tray 15. The sliding contact region α can be previously set using parameters such as a discharge angle or a discharge speed of the sheet P from the discharge rollers 31, a distance between the discharge rollers 31 and the bottom face 15*b* of the upper discharge tray 15 in the vertical direction Z, a size of the sheet P (for example, a maximum standard size), a firmness of the sheet P (for example, a maximum standard thickness), and a moving distance of the sheet P shifted by the sheet sorting unit 300.

Specifically, the guide rib 150 extends along the oblique direction toward the outside from the upstream side to the downstream side in the transport direction Y1, on one side and/or the other side with a center of the sheet P (transported in the transport direction Y1, before sorting or not being sorted, see FIG. 5) in the axial direction X (i.e., width direction along the surface of the sheet P, orthogonal to the transport direction Y1 in which the sheet P is transported) as a reference, i.e., on one side and/or the other side divided by an imaginary boundary line β along the transport direction Y1 (see FIGS. 5 and 8C) as a center in the axial direction X. In other words, the guide rib 150 (151 to 153 in this embodiment) extends in the oblique direction in which an angle θ of the guide rib (θ1 to θ3 in this embodiment, see FIG. 5) is an acute angle, the angle on the downstream side in the transport direction Y1 on the one side X1 and/or the other side X2 in the axial direction X with the imaginary boundary line β as the center. The guide rib 150 is integrally formed with the bottom face 15*b* of the upper discharge tray 15.

In this embodiment, the guide rib 150 disposed on the bottom face 15*b* of the upper discharge tray 15 extends in the oblique direction inclined to the shift movement side relative to the transport direction Y1. Thus, when the sheet P is shifted along the axial direction X by the sheet sorting unit 300 to be discharged while being transported in the transport direction Y1 by the discharge rollers 31, if the sheet P makes sliding contact with the bottom face 15*b* of the upper discharge tray 15, the sheet P can be discharged onto the discharge tray 14 while making sliding contact with the guide rib 150 in a state in which a contact area of the sheet P to the guide rib 150 is reduced. In this way, the sheet P, which is shifted along the axial direction X to be discharged while being transported in the transport direction Y1, is hardly caught by the bottom face 15*b* of the upper discharge tray 15.

First Embodiment

In the first embodiment, the guide rib 150 extends in or substantially in a sheet oblique movement direction W (see FIG. 5) of the sheet P that is shifted along the axial direction X by the sheet sorting unit 300 while being transported in the transport direction Y1 by the discharge rollers 31.

Specifically, the sheet oblique movement direction W is a direction of a vector composed of a vector of the transport speed Vc of the sheet P in the transport direction Y1 and a vector of the movement speed Vm of the sheet P in the axial direction X.

That is, the angle θ of the guide rib can be obtained by the following expression: $\theta=\cos^{-1}(Vc/\sqrt{(Vm^2+Vc^2)})$; or $\theta=\sin^{-1}(Vm/\sqrt{(Vm^2+Vc^2)})$.

In the first embodiment, the guide rib 150 extends in the sheet oblique movement direction W or substantially in the sheet oblique movement direction W. Thus, when the sheet P is shifted along the axial direction X to be discharged while being transported in the transport direction Y1, if the sheet P makes sliding contact with the bottom face 15*b* of the upper discharge tray 15, the sheet P can be discharged onto the discharge tray 14 while making sliding contact with the guide rib 150 in a state in which the contact area of the sheet P to the guide rib 150 is further reduced. In this way, the sheet P, which is shifted along the axial direction X to be discharged while being transported in the transport direction Y1, is further hardly caught by the bottom face 15*b* of the upper discharge tray 15.

Second Embodiment

When the guide rib 150 is disposed outside a sheet side edge Ps (sheet side edge Ps2 on the other side in the example shown in FIG. 5) in the axial direction X of the sheet P being shifted along the axial direction X (the other side X2 in the example shown in FIG. 5) by the sheet sorting unit 300 while being transported in the transport direction Y1 by the discharge rollers 31, the sheet P may not make contact with the guide rib 150 at the time of making sliding contact with the bottom face 15*b* of the upper discharge tray 15 when the sheet P is shifted along the axial direction X (the other side X2 in the example shown in FIG. 5) to be discharged while being transported in the transport direction Y1. Especially, when the guide rib 150 is constituted by a plurality of guide ribs 151 to 153 and includes an inner rib and an outer rib in the axial direction X, if the innermost guide rib 153 of the plurality of guide ribs 151 to 153 is disposed outside the sheet side edge Ps in the axial direction X of the sheet P being shifted along the axial direction X while being transported in the transport direction Y1, the sheet P does not make contact with the guide rib 150 at the time of making sliding contact with the bottom face 15*b* of the upper discharge tray 15 when the sheet P is shifted along the axial direction X to be discharged while being transported in the transport direction Y1. Therefore, it is desired that the sheet P reliably makes contact with the guide rib 150 when the sheet P makes sliding contact with the bottom face 15*b* of the upper discharge tray 15.

In this respect, in the second embodiment, the guide rib 150 is disposed inside (for example, in the vicinity of the inner side of) the sheet side edge Ps (sheet side edge Ps2 on the other side in the example shown in FIG. 5) in the axial direction X of the sheet P being shifted along the axial direction X (the other side X2 in the example shown in FIG. 5) by the sheet sorting unit 300 while being transported in the transport direction Y1 by the discharge rollers 31. Here, examples of the position in the vicinity of the inner side include a position inside the sheet side edge Ps in the axial direction X of the sheet P by a predetermined distance. Particularly, when the guide rib 150 is constituted by a plurality of guide ribs 151 to 153 and includes an inner rib and an outer rib in the axial direction X, it is preferable that the outermost guide rib 151 in the plurality of guide ribs 151 to 153 is disposed inside the sheet side edge Ps in the axial direction X of the maximum size sheet P being shifted along the axial direction X by the sheet sorting unit 300 while being transported in the transport direction Y1 by the discharge rollers 31.

In the second embodiment, the guide rib 150 is disposed inside the sheet side edge Ps in the axial direction X of the sheet P being shifted along the axial direction X by the sheet sorting unit 300 while being transported in the transport direction Y1 by the discharge rollers 31. Thus, when the sheet P is shifted along the axial direction X to be discharged while being transported in the transport direction Y1, if the sheet P makes sliding contact with the bottom face 15*b* of the upper discharge tray 15, the sheet P can easily make contact with the guide rib 150. In this way, it is possible that the sheet P reliably makes contact with the guide rib 150 at the time of making sliding contact with the bottom face 15*b* of the upper discharge tray 15.

Third Embodiment

When the guide rib 150 is disposed toward the downstream side from a position at an upstream side edge 15*c* (see FIGS. 5 to 7 and 8C) in the transport direction Y1 of the bottom face 15*b* of the upper discharge tray 15, it is possible to reduce the possibility that the sheet front edge P1 of the sheet P is caught by the guide rib 150 as much as possible or to eliminate the possibility. However, the material to form the guide rib 150 is needed accordingly. Thus, from the standpoint of reducing the material for the guide rib 150, when the guide rib 150 is disposed toward the downstream side from the position downstream of the position at the upstream side edge 15*c* of the bottom face 15*b* of the upper discharge tray 15, the sheet front edge P1 of the sheet P is easily caught by the guide rib. Thus, it is desired that the sheet front edge P1 of the sheet P is prevented from being caught by the guide rib 150 at the time of making sliding contact with the bottom face 15*b* of the upper discharge tray 15 even when the guide rib 150 is disposed toward the downstream side from the position downstream of the position at the upstream side edge 15*c* of the bottom face 15*b* of the upper discharge tray 15.

In this respect, in the third embodiment, the guide rib 150 is inclined so as to be gradually higher from the upstream side to the downstream side in the transport direction Y1 of the sheet P relative to the bottom face 15*b* of the upper discharge tray 15 (see FIGS. 8A, 8B and 9).

Specifically, the guide rib 150 is inclined with the bottom face 15*b* of the upper discharge tray 15 being the starting point. However, the configuration is not limited thereto. The guide rib 150 may be inclined with a position higher than the bottom face 15*b* of the upper discharge tray 15 being the starting point. Also, a top face 150*g* of the guide rib 150 (in this example, inclined faces 151*g*, 152*g* and 153*g*, see FIG. 9) has a plane face. However, the configuration is not limited thereto. The top face 150*g* of the guide rib 150 may be formed so as to have a curved face, e.g., an upwardly convex face or a downwardly convex face.

In the third embodiment, the guide rib 150 is inclined so as to be gradually higher from the upstream side to the downstream side in the transport direction Y1 of the sheet P relative to the bottom face 15*b* of the upper discharge tray 15. Thus, the height of the upstream side edge of the guide rib 150 (rear edge 150*b*, specifically in this embodiment, rear edges 151*b*, 152*b* and 153*b*, see FIG. 9) can be reduced or eliminated. Accordingly, it is possible to reduce the possibility that the sheet front edge P1 of the sheet P is caught by the guide rib 150, and furthermore it is possible that the sheet P smoothly makes sliding contact with the top face 150*g* of the guide rib 150 at the time of making sliding contact with the bottom face 15*b* of the upper discharge tray 15. In this way, even when the guide rib 150 is disposed toward the downstream side from the position downstream of the position at the upstream side edge 15*c* of the bottom face 15*b* of the upper discharge tray 15, the sheet front edge P1 of the sheet P is prevented from being caught by the guide rib 150 at the time of making sliding contact with the bottom face 15*b* of the upper discharge tray 15.

Fourth Embodiment

In the fourth embodiment, the guide rib 150 is constituted by a plurality of (three in this embodiment) guide ribs 151 to 153.

Specifically, the plurality of guide ribs 151 to 153 includes an inner rib and an outer rib in the axial direction X. The plurality of guide ribs 151 to 153 is arranged side by side in the axial direction X. The plurality of guide ribs 151 to 153 is in parallel or substantially in parallel with one another. When the plurality of guide ribs 151 to 153 is inclined so as to be gradually higher from the upstream side to the downstream side in the transport direction Y1 of the sheet P, as in the third embodiment, the inclination angles φ1 to φ3 (see FIG. 9) relative to the bottom face 15*b* of the upper discharge tray 15 may be equal or substantially equal to one another, or at least two of them may differ from each other. Furthermore, in the plurality of guide ribs 151 to 153, the angles of the guide ribs θ (θ1 to θ3) and/or the lengths thereof may be equal or substantially equal to one another, or at least two of the respective angles θ1 to θ3 and/or the respective lengths may differ from each other. In this embodiment, the angles θ1 to θ3 of the guide ribs are equal or substantially equal to one another, and the lengths of the guide ribs 151 and 152 are equal or substantially equal to each other.

In the fourth embodiment, since the guide rib 150 is constituted by the plurality of guide ribs 151 to 153, the plurality of guide ribs 151 to 153 may be disposed according to the size of the sheet P (specifically, size in the axial direction X). Thus, when the sheet P is shifted along the axial direction X to be discharged while being transported in the transport direction Y1, if each sheet P having the corresponding size makes sliding contact with the bottom face 15*b* of the upper discharge tray 15, each sheet P having the corresponding size is hardly caught by the bottom face 15*b* of the upper discharge tray 15.

For example, the outermost guide rib 151 in the plurality of guide ribs 151 to 153 is disposed inside (for example, in the vicinity of the inner side of) the sheet side edge Ps (sheet side edge Ps2 on the other side in the example shown in FIG. 5) in the axial direction X of the maximum size sheet P being shifted along the axial direction X by the sheet sorting unit 300 while being transported in the transport direction Y1 by the discharge rollers 31. Each of the n-th guide ribs 152 and 153 (n=1, 2 in this embodiment), which is disposed at the n-th inner position (n is an integer of 1 or more) from the outermost guide rib 151, exemplarily shows the aspect in which it is located inside (for example, in the vicinity of the inner side of) the sheet side edge Ps (sheet side edge Ps2 on the other side in the example shown in FIG. 5) in the axial direction X of the n-th smallest size sheet P compared with the maximum size, n-th smallest size sheet P being shifted along the axial direction X by the sheet sorting unit 300 while being transported in the transport direction Y1 by the discharge rollers 31. In this way, when each sheet P having the corresponding size is shifted along the axial direction X to be discharged while being transported in the transport direction Y1, if each sheet P having the corresponding size makes sliding contact with the bottom face 15*b* of the upper discharge tray 15, not only the maximum size sheet P but also n-th smallest size sheet P can be effectively prevented from being caught by the bottom face 15*b* of the upper discharge tray 15. Here, examples of the position in the vicinity of the inner side include the position inside the sheet side edge Ps in the axial direction X of the sheet P by a predetermined distance.

Fifth Embodiment

When the guide rib 150 is constituted by the plurality of guide ribs 151 to 153 and includes an inner rib and an outer rib in the axial direction X, the guide rib (guide rib 153 in this embodiment) out of the plurality of guide ribs 151 to 153, which is disposed inside a predetermined reference guide rib (guide rib 152 in this embodiment), may serve as an auxiliary guide member for the outer guide ribs (151 and 152 in this embodiment) including the reference guide rib (guide rib 152 in this embodiment). In this case, if the inner guide rib 153 is formed so as to have the same or substantially the same length as those of the outer guide ribs 151 and 152, the amount of the material to form the inner guide rib 153 increases accordingly, which leads to weight increase and cost increase of the upper discharge tray 15. Therefore, it is desired to reduce the used amount of the material to form the inner guide rib 153 so as to realize weight saving and cost saving of the upper discharge tray 15.

In this respect, in the fifth embodiment, out of the plurality of guide ribs 151 to 153, the inner guide rib 153 is formed shorter than the outer guide ribs 151 and 152, with the downstream side part of the inner guide rib 153 in the transport direction Y1 being maintained. The inner guide rib 153 is inclined so as to be gradually higher from the upstream side to the downstream side in the transport direction Y1 of the sheet P relative to the bottom face 15*b* of the upper discharge tray 15.

Specifically, the inner guide rib 153 lacks its upstream side (not formed) while maintains a predetermined length d (see FIG. 8C) from the downstream side edge (front edge 153*a*).

In the fifth embodiment, out of the plurality of guide ribs 151 to 153, the inner guide rib 153 is formed shorter than the outer guide ribs 151 and 152, with the downstream side part of the inner guide rib 153 in the transport direction Y1 being maintained. Thus, the amount of the material used to form the inner guide rib 153 can be reduced accordingly so as to realize weight saving and cost saving of the upper discharge tray 15. Meanwhile, if the inner guide rib 153 is formed shorter than the outer guide ribs 151 and 152 while it is maintained on the downstream side in the transport direction Y1, the sheet front edge P1 of the sheet P may be likely to be caught by the inner guide rib 153 when the sheet P makes sliding contact with the bottom face 15*b* of the upper discharge tray 15. However, since the inner guide rib 153 is inclined so as to be gradually higher from the upstream side to the downstream side in the transport direction Y1 of the sheet P relative to the bottom face 15*b* of the upper discharge tray 15, when the sheet P is shifted along the axial direction X to be discharged while being transported in the transport direction Y1, if the sheet P makes sliding contact with the bottom face 15*b* of the upper discharge tray 15, the sheet P can smoothly make sliding contact with the inclined face 153*g* (150*g*) of the inner guide rib 153 in a state in which the material to form the guide rib 150 is reduced. In this way, the sheet front edge P1 of the sheet P is prevented from being caught by the inner guide rib 153 when the sheet P makes sliding contact with the bottom face 15*b* of the upper discharge tray 15, while achieving weight saving and cost saving of the upper discharge tray 15.

Sixth Embodiment

When the inner guide rib 153 is formed shorter than the outer guide ribs 151 and 152 while it is maintained on the downstream side in the transport direction Y1, if the inclination angle φ3 of the inclined face 153*g* (150*g*), which face the discharge tray 14, of the inner guide rib 153 relative to the bottom face 15*b* of the upper discharge tray 15 is the same or substantially the same as, or smaller than the inclination angles φ1 and φ2 of the top faces (inclined faces 151*g* and 152*g* (150*g*) in this embodiment), which face the discharge tray 14, of the outer guide ribs 151 and 152 relative to the bottom face 15*b* of the upper discharge tray 15, the sheet front edge P1 of the sheet P is likely to be caught by the upstream side edge (rear edge 153*b*) of the inner guide rib 153 in the transport direction Y1. Therefore, it is desired that the sheet front edge P1 of the sheet P is hardly caught by the rear edge 153*b* of the inner guide rib 153.

In this respect, in the sixth embodiment, the inclination angle φ3 of the inclined face 153*g* (150*g*) of the inner guide rib 153 relative to the bottom face 15*b* of the upper discharge tray 15 is larger than the angles (inclination angles φ1 and φ2 in this embodiment) of the top faces (inclined faces 151*g* and 152*g* (150*g*) in this embodiment) of the outer guide ribs 151 and 152 relative to the bottom face 15*b* of the upper discharge tray 15.

Specifically, the downstream side edges (front edge 150*a*, specifically in this embodiment, front edges 151*a*, 152*a* and 153*a*, see FIG. 9) of the plurality of guide ribs 151, 152 and 153 in the transport direction Y1 are aligned in the axial direction X. Furthermore, the guide ribs 151, 152 and 153 have the same or substantially the same height at the downstream side edge (front edge 150*a*, specifically in this embodiment, front edges 151*a*, 152*a* and 153*a*).

In the sixth embodiment, the inclination angle φ3 of the inclined face 153*g* (150*g*) of the inner guide rib 153 relative to the bottom face 15*b* of the upper discharge tray 15 is larger than the angles (inclination angles φ1 and φ2 in this embodiment) of the top faces (inclined faces 151*g* and 152*g* (150*g*) in this embodiment) of the outer guide ribs 151 and 152 relative to the bottom face 15*b* of the upper discharge tray 15. Thus, the inner guide rib 153 extends without protruding from the outer guide ribs 151 and 152. In this way, when the sheet P is shifted along the axial direction X to be discharged while being transported in the transport direction Y1, if the sheet P makes sliding contact with the bottom face 15*b* of the upper discharge tray 15, the sheet front edge P1 of the sheet P is hardly caught or not caught by the rear edge 153*b* of the inner guide rib 153.

Seventh Embodiment

When the inner guide rib 153 is simply inclined, the inclination angle φ3 increases as the inner guide rib 153 is made shorter, accordingly, the possibility that the sheet front edge P1 of the sheet P is caught by the inclined face 153*g* (150*g*) of the inner guide rib 153 increases when the sheet P makes sliding contact with the bottom face 15*b* of the upper discharge tray 15. Therefore, it is desired to reduce the inclination angle φ3 even when the inner guide rib 153 is made shorter, and to reduce the possibility that the sheet front edge P1 of the sheet P is caught by the inclined face 153*g* (150*g*) of the inner guide rib 153 when the sheet P makes sliding contact with the bottom face 15*b* of the upper discharge tray 15.

In this respect, in the seventh embodiment, the inner guide rib 153 is constituted by a plurality of (two in this embodiment) inclined rib parts (1531 and 1532 in this embodiment) connected to each other from the upstream side to the downstream side in the transport direction Y1. The inclination angle (φ31 in this embodiment) of the upstream side inclined rib part (1531 in this embodiment) is larger than the inclination angle (φ32 in this embodiment) of the downstream side inclined rib part (1532 in this embodiment).

Specifically, the inner guide rib 153 is constituted by a first inclined rib part 1531 (see FIG. 9) and a second inclined rib part 1532 (see FIG. 9), respectively located on the upstream side and the downstream side in the transport direction Y1. The inclination angle φ31 (φ3) of the first inclined rib part 1531 on the upstream side is larger than the inclination angle φ32 (φ3) of the second inclined rib part 1532 on the downstream side. In the inner guide rib 153, the downstream side edge of the first inclined rib part 1531 is connected to the upstream side edge of the second inclined rib part 1532. Also, in the inner guide rib 153, the plurality of inclined rib parts (the first inclined rib part 1531 and the second inclined rib part 1532 in this embodiment) is integrally formed. The inclined face 153*g* (150*g*) of the plurality of inclined rib parts (the first inclined rib part 1531 and the second inclined rib part 1532 in this embodiment) is formed so as to have a plane face. However, the configuration is not limited thereto. The inclined face 153*g* (150*g*) of the plurality of inclined rib parts (the first inclined rib part 1531 and the second inclined rib part 1532 in this embodiment) may be formed so as to have a curved face, e.g., an upwardly convex face or a downwardly convex face.

In the seventh embodiment, the inner guide rib 153 is constituted by the plurality of inclined rib parts (1531 and 1532 in this embodiment) connected to each other from the upstream side to the downstream side in the transport direction Y1, and the inclination angle (φ31 in this embodiment) of the upstream side inclined rib part (1531 in this embodiment) is larger than the inclination angle (φ32 in this embodiment) of the downstream side inclined rib part (1532 in this embodiment). Thus, even when the sheet P makes sliding contact with the bottom face 15*b* of the upper discharge tray 15, the sheet P can make sliding contact with the inner guide rib 153 that has multiple stages of inclination angle φ3 (two stages of inclination angles φ31 and φ32 in this embodiment) of the plurality of inclined rib parts (the first inclined rib part 1531 and the second inclined rib part 1532 in this embodiment), in other words, the sheet P can make sliding contact with the inner guide rib 153 in which the plurality of inclined rib parts (the first inclined rib part 1531 and the second inclined rib part 1532 in this embodiment) is inclined from the upstream side to the downstream side in the transport direction Y1 so that the inclination angle φ3 (φ31 and φ32 in this embodiment) decreases in stages. In this way, even when the inner guide rib 153 is made shorter, it is possible to reduce the inclination angle φ3, thus it is possible to reduce the possibility that the sheet front edge P1 of the sheet P is caught by the inclined face 153*g* (150*g*) of the inner guide rib 153 when the sheet P makes sliding contact with the bottom face 15*b* of the upper discharge tray 15.

Eighth Embodiment

On the bottom face 15*b* of the upper discharge tray 15, a cross rib 160 (see FIGS. 7, 8B, 8C and 9) may be disposed so as to extend along the direction intersecting with the guide rib 150 (for example, the axial direction X and the transport direction Y1). For example, due to the space SP disposed under the bottom face 15*b* of the upper discharge tray 15, the part that can support the upper discharge tray 15 is limited. For this reason, the cross rib 160, which is a reinforcing rib for reinforcing the upper discharge tray 15 is often disposed in order to ensure the strength of the upper discharge tray 15. In this case, at least one of the following is likely to be caught by the cross rib 160 (for example, reinforcing rib): the sheet front edge P1 of the sheet P; sheet side edge Ps1 or Ps2 (Ps2 in this embodiment) in the axial direction X; and a corner part of the sheet front edge P1 and the sheet side edge Ps1 or Ps2 (i.e., angle made by the two edges). Especially, the corner part of the sheet front edge P1 and the sheet side edge Ps1 or Ps2 is likely to be caught. Thus, it is desired to reduce the catch by the cross rib 160 of at least one of the sheet front edge P1 of the sheet P; sheet side edge Ps1 or Ps2 (Ps2 in this embodiment) in the axial direction X; and the corner part of the sheet front edge P1 and the sheet side edge Ps1 or Ps2, especially, the catch of the corner part of the sheet front edge P1 and the sheet side edge Ps1 or Ps2. This problem typically occurs when the cross rib 160 extends along an edge portion of a downstream side edge 15*d* of the bottom face 15*b* of the upper discharge tray 15 in the transport direction Y1 (see FIGS. 5, 6, 7, 8B, 8C and 9).

In this respect, in the eighth embodiment, the cross rib 160 is disposed on the bottom face 15*b* of the upper discharge tray 15 so as to extend along the direction intersecting with the guide rib 150. The guide rib 150 has a height higher than the height of the cross rib 160.

Specifically, the cross rib 160 includes a first cross rib 161 that extends in the direction in parallel or substantially in parallel with the axial direction X (see FIGS. 7, 8B, 8C and 9) and second cross ribs 162 that extend in the direction in parallel or substantially in parallel with the transport direction Y1 (see FIGS. 7, 8C and 9). The first cross rib 161 is disposed on the edge portion of the downstream side edge 15*d* of the bottom face 15*b* of the upper discharge tray 15 in the transport direction Y1. A plurality of second cross ribs 162 is disposed at predetermined intervals in the axial direction X. The cross rib 160 is integrally formed with the bottom face 15*b* of the upper discharge tray 15.

Also, the cross rib 160 may be disposed so as to intersect with the guide rib 150, or so as to not intersect with the guide rib 150. When the cross rib 160 is disposed so as to intersect with the guide rib 150, it may be connected to (specifically, integrally formed with) the guide rib 150, or may be absent (not disposed) at the intersecting part (in the vicinity of the intersecting part). When the guide rib 150 is constituted by the plurality of guide ribs 151 to 153, the cross rib 160 may be connected to (specifically, integrally formed with) at least two of the plurality of guide ribs 151 to 153. In this way, at least two of the plurality of guide ribs 151 to 153 can be stiffly reinforced.

In this embodiment, in the first cross rib 161, an inner side face 161*a* (see FIG. 9) is connected to (specifically, integrally formed with) the front edges 151*a*, 152*a* and 153*a* of the plurality of guide ribs 151 to 153. Out of the plurality of second cross ribs 162, one second cross rib 162 is connected to (specifically, integrally formed with) the plurality of guide ribs 151 to 153 so that the plurality of guide ribs 151 to 153 is coupled to each other. The cross rib 160 further includes a third cross rib 163 (see FIG. 9) to reinforce the plurality of guide ribs 151 to 153. As shown in FIG. 9, the third cross rib 163 includes a connecting part 163*a*, a first end part 163*b* and a second end part 163*c*. The connecting part 163*a* extends in the direction in parallel or substantially in parallel with the axial direction X (i.e., being in parallel or substantially in parallel with the first cross rib 161) and is connected to (specifically, integrally formed with) the plurality of guide ribs 151 to 153 so that the plurality of guide ribs 151 to 153 is coupled to each other. The first end part 163*b* is connected to (specifically, integrally formed with) the outermost guide rib 151 in the plurality of guide ribs 151 to 153 and a main rib 170 (see FIG. 9) disposed at the end on the other side X2 in the axial direction X and at the downstream end in the transport direction Y1, so that the outermost guide rib 151 and the main rib 170 are coupled to each other. The second end part 163*c* is connected to (specifically, integrally formed with) the innermost guide rib 153 in the plurality of guide ribs 151 to 153 and the first cross rib 161, so that the innermost guide rib 153 and the first cross rib 161 are coupled to each other. In this way, the plurality of guide ribs 151 to 153 can be further stiffly reinforced.

In the eighth embodiment, the cross rib 160 is disposed on the bottom face 15*b* of the upper discharge tray 15 so as to extend along the direction intersecting with the guide rib 150. The guide rib 150 has the height higher than the height of the cross rib 160. Thus, the guide rib 150 can effectively prevent the sheet P from making contact with the cross rib 160 when the sheet P makes sliding contact with the bottom face 15*b* of the upper discharge tray 15. Accordingly, when the sheet P is shifted along the axial direction X to be discharged while being transported in the transport direction Y1, if the sheet P makes sliding contact with the bottom face 15*b* of the upper discharge tray 15, it is possible to reduce the catch by the cross rib 160 of at least one of the sheet front edge P1 of the sheet P; the sheet side edge Ps1 or Ps2 (Ps2 in this embodiment) in the axial direction X; and the corner part of the sheet front edge P1 and the sheet side edge Ps1 or Ps2, especially, the catch of the corner part of the sheet front edge P1 and the sheet side edge Ps1 or Ps2. This is considerably effective when the first cross rib 161 extends along the edge portion of the downstream side edge 15*d* of the bottom face 15*b* of the upper discharge tray 15 in the transport direction Y1.

Ninth Embodiment

In the case where the all ribs of the guide rib 150 are linearly arranged along the oblique direction and where the sheet P makes sliding contact with the guide rib 150, if there exists, in the sliding contact region α in the bottom face 15*b* of the upper discharge tray 15, a transport-direction sliding contact region α1 (see FIG. 5) with which the sheet P is to make sliding contact when it is only moved in the transport direction Y1 in an initial sliding-contact period, the contact area of the sheet P to the guide rib 150 increases in the transport-direction sliding contact region α1. Therefore, it is desired to prevent the sheet P from being caught by the guide rib 150 when the sheet P makes sliding contact with the bottom face 15*b* of the upper discharge tray 15 by reducing the contact area of the sheet P to the guide rib 150 in the transport-direction sliding contact region α1 when the sheet P makes sliding contact with the guide rib 150.

In this respect, in the ninth embodiment, the guide rib 150 includes a rib end part 150*c* (see FIGS. 5, 8C and 9) that is disposed on the downstream side by a predetermined distance from the upstream side edge 15*c* in the transport direction Y1, and that is in parallel or substantially in parallel with the transport direction Y1.

Specifically, the rib end part 150*c* is disposed so as to extend across the entire or a part of transport-direction sliding contact region α1 with which the sheet P is to make sliding contact when it is only moved in the transport direction Y1 in the initial sliding-contact period. At least one of the plurality of guide ribs 151 to 153 (the outer guide ribs 151 and 152 in this embodiment) includes rib end part 151*c* and/or 152*c* (see FIGS. 5, 8C and 9).

In the ninth embodiment, the guide rib 150 includes the rib end part 150*c* (151*c* and 152*c* in this embodiment) that is disposed on the downstream side by the predetermined distance from the upstream side edge 15*c* in the transport direction Y1 and that is in parallel or substantially in parallel with the transport direction Y1. Thus, in sliding contact of the sheet P with the guide rib 150, even when there exists, in the region of the guide rib 150 with which the sheet P makes sliding contact, the transport-direction sliding contact region α1 with which the sheet P is to make sliding contact when it is only moved in the transport direction Y1 in the initial sliding-contact period, it is possible to reduce as much as possible the contact area of the sheet P to the guide rib 150 in the transport-direction sliding contact region α1. In this way, it is possible to reduce the contact area of the sheet P to the guide rib 150 in the transport-direction sliding contact region α1 when the sheet P makes sliding contact with the guide rib 150 so as to prevent the sheet P from being caught by the guide rib 150 when the sheet P makes sliding contact with the bottom face 15*b* of the upper discharge tray 15.

Tenth Embodiment

When the discharge rollers 31 are shifted to both of the one side X1 and the other side X2 in the axial direction X, the guide rib 150 may be disposed on both side to which the discharge rollers 31 are shifted. However, in this case, there may occur a problem below.

That is, in the one side X1 and the other side X2 (the one side X1 in this embodiment) of the bottom face 15*b* of the upper discharge tray 15 with a center of the sheet P (that is transported in the transport direction Y1) in the axial direction X as a reference (i.e., divided by the imaginary boundary line β), from the standpoint of disposing a narrowed part 15*e* (see FIGS. 5 to 7, 8C and 9) that is recessed toward the inside in the axial direction X of the upper discharge tray 15 so as to easily remove the discharged sheet P, or/and furthermore from the standpoint of space saving, the whole area of the one side X1 (more specifically, the area downstream of the center of the one side X1 in the transport direction Y1) and/or the whole area of the other side X2 (more specifically, the area downstream of the center of the other side X2 in the transport direction Y1) of the bottom face 15*b* is/are decreased. Thus, the area of the sliding contact region α of the bottom face 15*b* is decreased, which hardly exerts or does not exert at all the influence of catch by the bottom face 15*b* on the sheet P. If the guide rib 150 is provided in spite of miner or no influence of the catch by the bottom face 15*b* on the sheet P, the material to form the guide rib 150 is wastefully used. Therefore, it is desired to reduce the waste of the material to from the guide rib 150.

In this respect, in the tenth embodiment, the discharge rollers 31 are shifted to both of the one side X1 and the other side X2 in the axial direction X. Out of the one side X1 and the other side X2 of the bottom face 15*b* of the upper discharge tray 15 with the center of the sheet P (that is transported in the transport direction Y1) in the axial direction X as the reference (i.e., divided by the imaginary boundary line β), the guide rib 150 is disposed on a side where the area of the sliding contact region α is larger than a predetermined reference area (a side opposite to the operation side in this embodiment, the upper side in FIG. 5). That is, in the bottom face 15*b*, when the area of the sliding contact region α in the one side X1 defined on the basis of the center in the axial direction X is larger than the reference area, the guide rib 150 is disposed on the one side X1. When the area of the sliding contact region α in the other side X2 is larger than the reference area, the guide rib 150 is disposed on the other side X2. Also, when the respective areas of the sliding contact region α in both of the one side X1 and the other side X2 are larger than the reference area, the guide rib 150 is disposed on both of the one side X1 and the other side X2.

In other words, the guide rib 150 is not disposed on the side where the area of the sliding contact region α is not more than the reference area (operation side in this embodiment, lower side in FIG. 5) out of the one side X1 and the other side X2 of the bottom face 15*b*.

Here, the reference area means the area in which little or no influence of catch by the bottom face 15*b* on the sheet P should be considered.

In the tenth embodiment, the discharge rollers 31 are shifted to both of the one side X1 and the other side X2 in the axial direction X. Out of the one side X1 and the other side X2 of the bottom face 15*b* of the upper discharge tray 15 with the center of the sheet P (that is transported in the transport direction Y1) in the axial direction X as the reference, the guide rib 150 is disposed on the side (the other side X2 in the example shown in FIG. 5) where the area of the sliding contact region α is larger than the predetermined reference area. Thus, it is possible to dispose the guide rib on a part where it is necessary in the bottom face 15*b* of the upper discharge tray 15, which results in reduction in material to form the guide rib 150.

Eleventh Embodiment

Figure 10A:
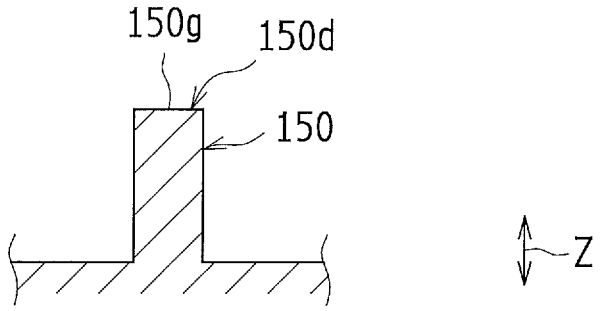
FIG. 10A is a schematic cross-sectional view showing one example (Example 1) of cross sections of the guide rib when viewed diagonally, where a top part of the guide rib is a plane face or a curved face.

FIGS. 10A to 12C are each a schematic cross-sectional view showing a cross section of the guide rib 150 when viewed diagonally. FIGS. 10A to 10C each show an example of the cross section of the guide rib 150 where a top part 150*d* is a plane face or a curved face. FIGS. 11A to 11D and 12A to 12C each show an example of the cross section of the guide rib 150 having an inclined side face 150*e*.

Figure 10B:
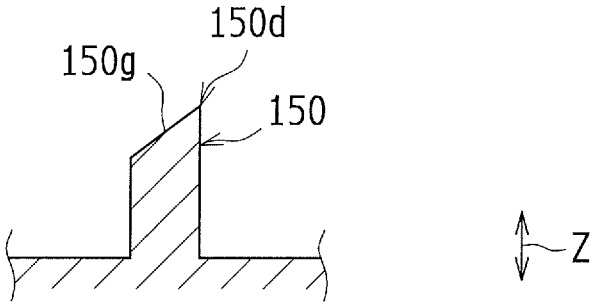
FIG. 10B is a schematic cross-sectional view showing one example (Example 2) of cross sections of the guide rib when viewed diagonally, where the top part of the guide rib is a plane face or a curved face.
Figure 10C:
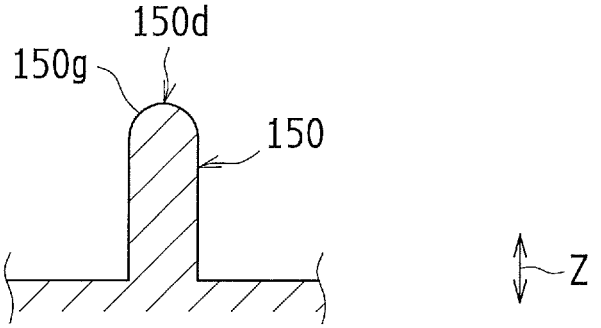
FIG. 10C is a schematic cross-sectional view showing one example (Example 3) of cross sections of the guide rib when viewed diagonally, where the top part of the guide rib is a flat face or a curved face.
Figure 11A:
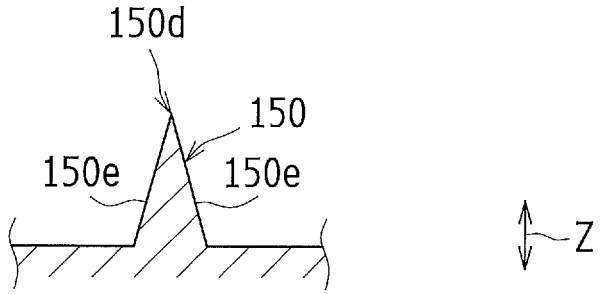
FIG. 11A is a schematic cross-sectional view showing one example (Example 1) of cross sections of the guide rib having an inclined side face, when viewed diagonally.
Figure 11B:
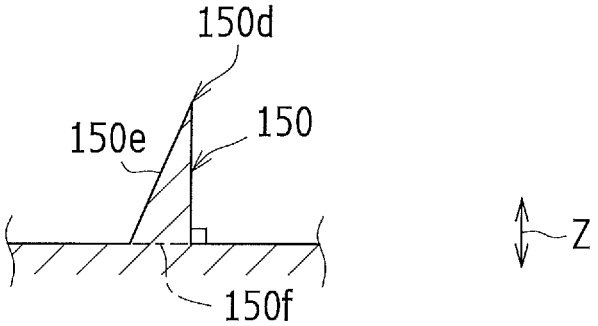
FIG. 11B is a schematic cross-sectional view showing one example (Example 2) of cross sections of the guide rib having an inclined side face, when viewed diagonally.
Figure 11C:
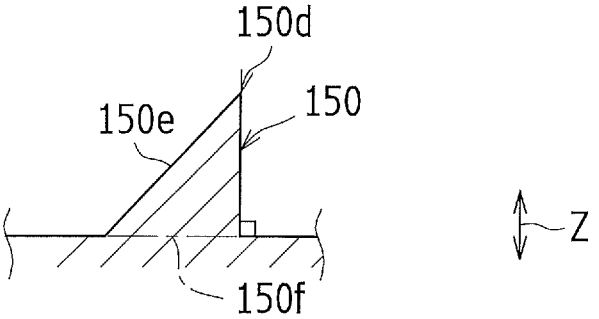
FIG. 11C is a schematic cross-sectional view showing one example (Example 3) of cross sections of the guide rib having an inclined side face, when viewed diagonally.
Figure 11D:
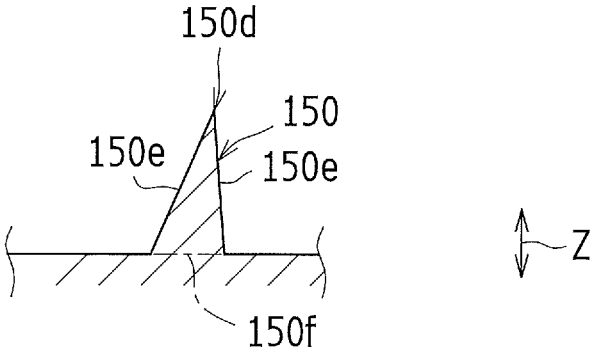
FIG. 11D is a schematic cross-sectional view showing one example (Example 4) of cross sections of the guide rib having an inclined side face, when viewed diagonally.

As shown in FIGS. 10A to 10C, the guide rib 150 includes a vertical or substantially vertical side and the top part 150*d* (top face 150*g*) that faces the discharge tray 14 and that has a plane face (see FIGS. 10A and 10B) or a curved face (see FIG. 10C) viewed in cross-section.

Examples of the cross-section of the plane face include a horizontal or substantially horizontal face (see FIG. 10A) and an orthogonal-direction inclined face (see FIG. 10B) that is inclined in a direction orthogonal or substantially orthogonal to the direction in which the guide rib 150 extends (oblique direction). The orthogonal-direction inclined face (see FIG. 10B) may be inclined to one side or the other side in the direction orthogonal or substantially orthogonal to the guide rib 150. Also, examples of the curved face (see FIG. 10C) include an upwardly convex face (specifically, an arc-shaped curved face). The curved face may be a hemispherical face or a semi-ellipsoidal face.

Also, as shown in FIG. 11A to 12C, the guide rib 150 includes the inclined side face 150*e* that is inclined so as to gradually decrease its width (size in the orthogonal direction) from the base end part to the top part 150*d* viewed in cross-section.

Figure 12A:
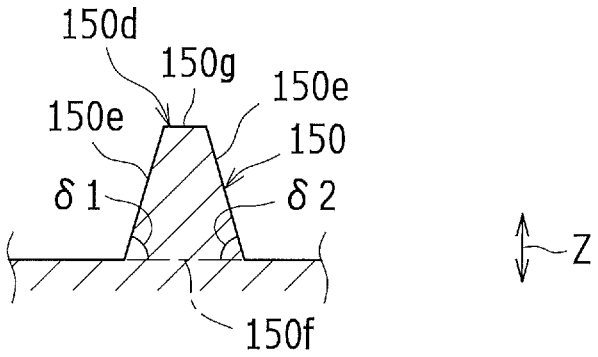
FIG. 12A is a schematic cross-sectional view showing one example (Example 5) of cross sections of the guide rib having an inclined side face, when viewed diagonally.
Figure 12B:
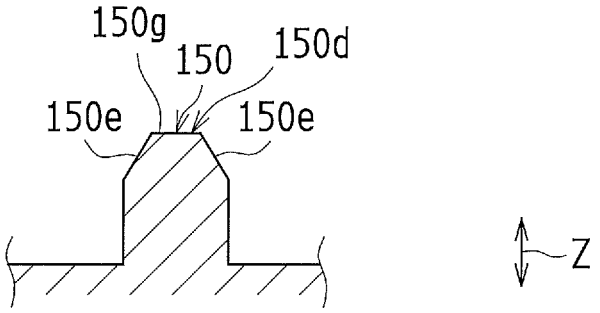
FIG. 12B is a schematic cross-sectional view showing one example (Example 6) of cross sections of the guide rib having an inclined side face, when viewed diagonally.
Figure 12C:
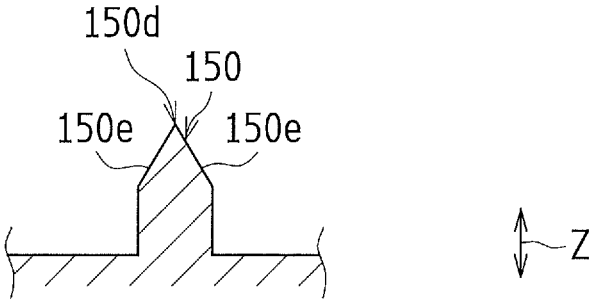
FIG. 12C is a schematic cross-sectional view showing one example (Example 7) of cross sections of the guide rib having an inclined side face, when viewed diagonally.

Examples of the cross-section of the guide rib 150 having the inclined side face 150*e* include polygonal shapes, specifically the following: an isosceles triangle or substantially isosceles triangle shape (see FIG. 11A); a right triangle or substantially right triangle shape (see FIG. 11B); an isosceles right triangle or substantially isosceles right triangle shape (see FIG. 11C); a triangle shape such as an acute-angled triangle shape (see FIG. 11D); a chevron-type trapezoid shape (see FIG. 12A) in which the upper base (top face 150*g* side) is smaller than the lower base (base end part 150*f* side) and the respective angles 61 and 62 between the lower base (base end part 150*f* side) and both legs are not more than or substantially not more than 90°; a hexagonal or substantially hexagonal shape in which the sides are vertical or substantially vertical and the upper side is horizontal or substantially horizontal (see FIG. 12B); and a pentagonal or substantially pentagonal shape in which the sides are vertical or substantially vertical (see FIG. 12C).

As shown in FIGS. 10B, 11A to 11D and 12C, when the tip of the guide rib 150 is pointed, the tip may be chamfered (for example, it may be formed in a flat or an arc shape).

Here, as shown in FIGS. 10B, 10C, 11A to 11D and 12C, it is preferable to form the guide rib 150 so that the top part 150*d* makes line contact or substantially line contact with the sheet P when the sheet P makes sliding contact with the guide rib 150.

Like this, since the guide rib 150 is formed so that the top part 150*d* makes line contact or substantially line contact with the sheet P when the sheet P makes sliding contact with the guide rib 150, it is possible that the sheet P makes sliding contact with the guide rib 150 and is discharged onto the discharge tray 14 in a state in which the contact area of the sheet P to the guide rib 150 is further reduced when the sheet P makes sliding contact with the bottom face 15*b* of the upper discharge tray 15. In this way, the sheet P, which is shifted along the axial direction X to be discharged while being transported in the transport direction Y1, is further hardly caught by the bottom face 15*b* of the upper discharge tray 15.

Twelfth Embodiment

Next, a sheet discharge device according to the twelfth embodiment of the present invention will be described with reference to the drawings. Since the twelfth embodiment differs from the above-described embodiments only in the configuration of the upper discharge tray 15, the drawings show only the main part, and other drawings are omitted.

Figure 13:
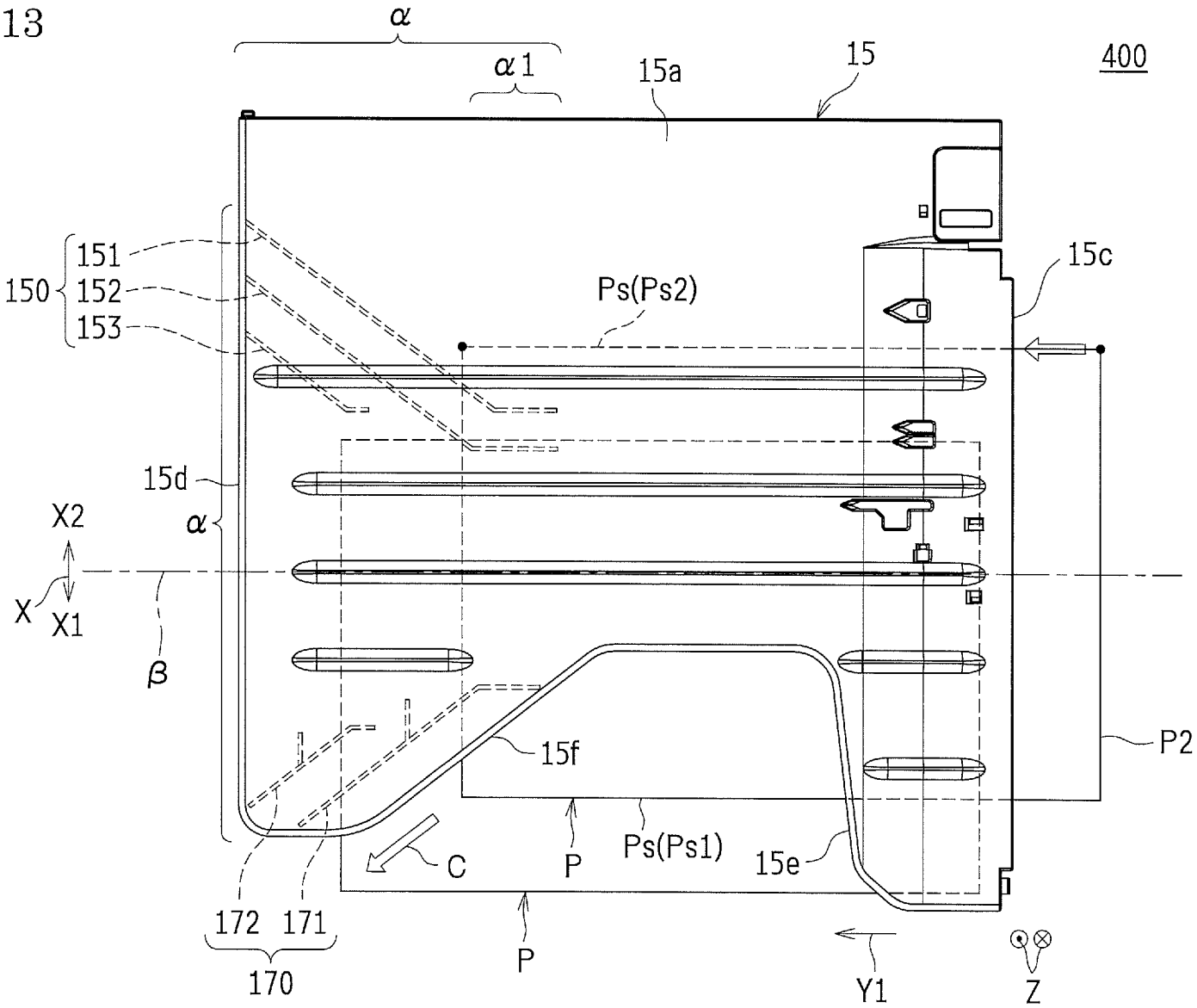
FIG. 13 is a schematic plan view showing a state in which a sheet is discharged under the upper discharge tray in the sheet discharge device according to the twelfth embodiment of the present invention when viewed in a plan view.
Figure 14:
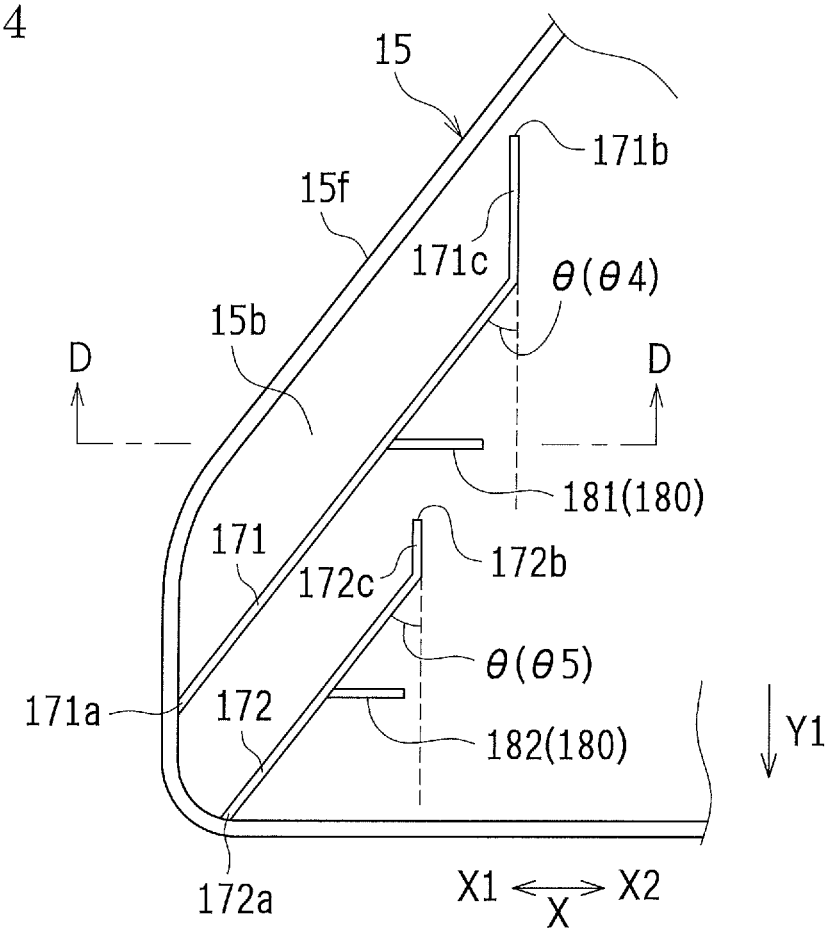
FIG. 14 is an enlarged bottom view showing the vicinity of a front side guide rib, in an enlarged manner, of the bottom face of the upper discharge tray in FIG. 13.

FIG. 13 is a schematic plan view showing a state in which a sheet is discharged under the upper discharge tray in the sheet discharge device according to the twelfth embodiment when viewed in a plan view. FIG. 14 is an enlarged bottom view showing the vicinity of a front side guide rib, in an enlarged manner, of the bottom face of the upper discharge tray in FIG. 13.

In the upper discharge tray 15 shown in FIG. 5, the guide rib 150 is disposed in the side edge portion on the other side X2 of the bottom face 15*b* of the upper discharge tray 15 in the axial direction X of the discharge rollers 31. On the other hand, in the twelfth embodiment, the respective guide ribs are disposed in both side edge portions of the bottom face 15*b* of the upper discharge tray 15 in the axial direction X of the discharge rollers 31. Hereinafter, occasionally, for the sake of distinguishing the respective guide ribs, the guide rib 150 disposed in the side edge portion on the other side X2 (upper side in FIG. 13) is referred to as a back side guide rib 150, and the guide rib disposed in the side edge portion on the one side X1 (lower side in FIG. 13) is referred to as a front side guide rib 170. Also, since the back side guide rib 150 has the same configuration as shown in FIG. 5 and the like, the description thereon is omitted.

As described above, the discharge rollers 31 are shifted to both sides in the axial direction X. FIG. 13 shows the sheet P being shifted to the one side X1 to be discharged. By shifting the discharge rollers 31, the sheet P is discharged toward a front side movement direction C that is inclined to the one side X1 relative to the transport direction Y1. This embodiment is not limited thereto. By shifting the discharge rollers 31 to the other side X2, the sheet P can be discharged toward the above-described sheet oblique movement direction W.

A front side guide rib 170 extends in the front side movement direction C or substantially in the front side movement direction C. The specific direction of the front side movement direction C can be obtained in a manner similar to that of the sheet oblique movement direction W. In this embodiment, two front side guide ribs 170 are disposed. The one closer to the side edge portion of the one side X1 of the upper discharge tray 15 is referred to as a "first front side guide rib 171", while the farther one is referred to as a "second front side guide rib 172".

The front side guide rib 170 is disposed at a position so that the front side guide rib 170 and the back side guide rib 150 are symmetric about the imaginary boundary line β in the axial direction X. The first front side guide rib 171 corresponds to the outer guide rib 152, and the second front side guide rib 172 corresponds to the inner guide rib 153. The configuration is not limited thereto. When the upper discharge tray 15 is enlarged toward the one side X1, the front side guide rib 170, which corresponds to the outer guide rib 151, may be disposed.

The front side guide rib 170 is configured substantially similarly to the back side guide rib 150. The front side guide rib 170 is inclined so as to be gradually higher from the upstream side to the downstream side in the transport direction Y1 of the sheet P relative to the bottom face 15*b* of the upper discharge tray 15. That is, the upstream side edge (rear edges 171*b* and 172*b*) of the front side guide rib 170 has a height substantially the same as the height of the bottom face 15*b*, and the height gradually increases as it gets closer to the downstream side edge (front edges 171*a* and 172*a*) so as to separate apart from the bottom face 15*b*.

Also, the front side guide rib 170 includes rib end parts 171*c* and 172*c* substantially in parallel with the transport direction Y1, the rib end parts 171*c* and 172*c* disposed in the vicinity of the upstream side edge of the front side guide rib 170. The downstream side of each rib end part 171*c* and 172*c* extends in the front side movement direction C. The angle θ (θ4) of the guide rib that is made by inclination of the first front side guide rib 171 relative to the transport direction Y1 and the angle θ (θ5) of the guide rib that is made by inclination of the second front side guide rib 172 relative to the transport direction Y1 are substantially the same as the angle θ (θ1 to θ3) of the back side guide rib 150.

The narrowed part 15*e* is disposed on the front side of the upper discharge tray 15 (in FIG. 13, on the lower side of the upper discharge tray 15). That is, the side of the one side X1 of the upper discharge tray 15 is recessed toward the other side X2. A part of the narrowed part 15*e* facing the front side guide rib 170 (tray oblique part 150 is a side in parallel with the front side movement direction C. That is, by providing the tray oblique part 15*f* in parallel with the front side guide rib 170, the side of the upper discharge tray 15 serves similarly to the front side guide rib 170.

On the bottom face 15*b* of the upper discharge tray 15 is disposed an auxiliary rib 180 that extends in the direction inclined relative to the transport direction Y1 and that is connected to the front side guide rib 170 with its edge. Specifically, the auxiliary rib 180 includes a first auxiliary rib 181 that is connected to the first front side guide rib 171 and a second auxiliary rib 182 that is connected to the second front side guide rib 172. In this embodiment, the auxiliary rib 180 extends in the axial direction X.

Figure 15:
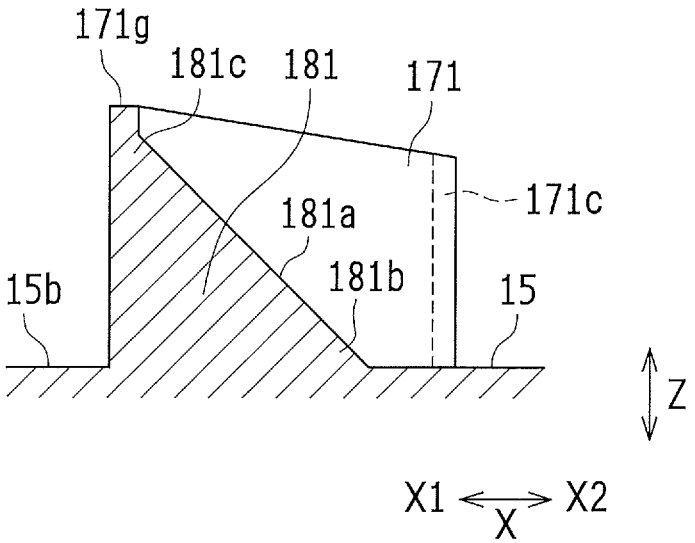
FIG. 15 is an enlarged cross-sectional view showing a cross section taken from arrows D-D of FIG. 14.

FIG. 15 is an enlarged cross-sectional view showing a cross section taken from arrows D-D of FIG. 14.

The top face (auxiliary top face 181*a*) of the first auxiliary rib 181 is inclined so as to be gradually higher from one end (separated end 181*b*) separated apart from the first front side guide rib 171 to the other end (connected end 181*c*) that is connected to the first front side guide rib 171 relative to the bottom face 15*b* of the upper discharge tray 15. The separated end 181*b* is located on the one side X1 further than the rib end part 151*c*. The connected end 181*c* is lower than the top face 171*g* of the first front side guide rib 171. That is, the first front side guide rib 171 protrudes from the bottom face 15*b* further than the first auxiliary rib 181. As the second auxiliary rib 182 has substantially the same configuration as the first auxiliary rib 181, the description thereon is omitted. As described above, by providing the auxiliary rib 180 that is connected to the side face of the guide rib, it is possible to prevent the sheet P from being caught by the side face of the guide rib.

Other Embodiments

In the above embodiments, the upper member is the upper discharge tray 15. However, any member may be used provided that such a member covers above the discharge tray 14. For example, it may be a member constituting the transport unit or casing, or may be a cover member, but not being limited thereto.

In the above embodiments, the discharge rollers 31 are shifted to both of the one side X1 and the other side X2 in the axial direction X. However, the discharge rollers 31 may be shifted to either one side out of the one side X1 and the other side X2 in the axial direction X.

The present invention can be embodied in other different forms without being limited to the above-described embodiments. Therefore, the embodiments disclosed herein should be considered in all respects as illustrative and should not be interpreted in a limited manner. The scope of the invention is indicated by the appended claims rather than by the foregoing description, and all modifications and changes that come within the meaning and range of equivalency of the claims are intended to be embraced therein.

What is claimed is:

1. An image forming apparatus, comprising:

discharge rollers configured to transport a sheet in a predetermined transport direction and to discharge the sheet onto a discharge tray; and an upper member disposed above the discharge tray with a space being interposed therebetween, wherein a bottom face of the upper member that faces the discharge tray includes at least one guide rib extending in an oblique direction inclined relative to the transport direction, wherein the at least one guide rib is located on a back side of the image forming apparatus relative to a center of the sheet discharged by the discharge rollers in a width direction, and wherein the at least one guide rib includes a rib end part that is disposed on a downstream side by a predetermined distance from an upstream side edge in the transport direction, and that is in parallel or substantially in parallel with the transport direction.

2. The image forming apparatus according to claim 1, further comprising:

a sheet sorting unit configured to sort a sheet to be discharged by shifting the discharge rollers along an axial direction of the discharge rollers, wherein the at least one guide rib extends in or substantially in a sheet oblique movement direction of the sheet being transported in the transport direction by the discharge rollers while being shifted along the axial direction by the sheet sorting unit.

3. The image forming apparatus according to claim 1, further comprising:

a sheet sorting unit configured to sort a sheet to be discharged by shifting the discharge rollers along an axial direction of the discharge rollers, wherein the at least one guide rib is located inside a side edge of the sheet in the axial direction, the sheet being transported in the transport direction by the discharge rollers while being shifted along the axial direction by the sheet sorting unit.

4. The image forming apparatus according to claim 1, wherein the at least one guide rib is inclined so that a length of the at least one guide rib in the direction from the bottom face of the upper member toward the discharge tray gradually increases from the upstream side to the downstream side in the transport direction.

5. The image forming apparatus according to claim 1, wherein the at least one guide rib comprises a plurality of guide ribs.

6. The image forming apparatus according to claim 5, wherein the plurality of guide ribs includes an inner guide rib and an outer guide rib in an axial direction of the discharge rollers, wherein the inner guide rib is formed shorter than the outer guide rib with a downstream side part of the inner guide rib in the transport direction being maintained, and wherein the at least one guide rib is inclined so that a length of the at least one guide rib in the direction from the bottom face of the upper member toward the discharge tray gradually increases from the upstream side to the downstream side in the transport direction.

7. The image forming apparatus according to claim 6, wherein an inclination angle of an inclined face, which faces the discharge tray, of the inner guide rib relative to the bottom face of the upper member is larger than an angle of a top face, which faces the discharge tray, of the outer guide rib relative to the bottom face of the upper member.

8. The image forming apparatus according to claim 7, wherein the inner guide rib is constituted by a plurality of inclined rib parts connected to each other from the upstream side to the downstream side in the transport direction, and wherein an inclination angle of an inclined rib part on the upstream side out of the plurality of inclined rib parts is larger than an inclination angle of an inclined rib part on the downstream side out of the plurality of inclined rib parts.

9. The image forming apparatus according to claim 1, wherein a cross rib is disposed on the bottom face of the upper member so as to extend along a direction intersecting with the at least one guide rib, and wherein the at least one guide rib has a height higher than a height of the cross rib.

10. The image forming apparatus according to claim 9, wherein the cross rib extends along an edge portion of a downstream side edge of the bottom face of the upper member in the transport direction.

11. The image forming apparatus according to claim 1, wherein an auxiliary rib is disposed on the bottom face of the upper member so as to extend in a direction inclined relative to the transport direction and to be connected, with its edge, to the at least one guide rib.

12. The image forming apparatus according to claim 1, further comprising:

an image reading unit configured to read an original so as to generate image data; and an image forming unit configured to form an image on a recording sheet, the image forming unit being disposed under the image reading unit, wherein the discharge tray and the upper member are disposed in a space between the image reading unit and the image forming unit, and wherein the recording sheet on which the image has been formed by the image forming unit is discharged onto either one of the discharge tray and the upper member.

13. An image forming apparatus, comprising:

discharge rollers configured to transport a sheet in a predetermined transport direction and to discharge the sheet onto a discharge tray; and an upper member disposed above the discharge tray with a space being interposed therebetween, wherein a bottom face of the upper member that faces the discharge tray includes at least one guide rib extending in an oblique direction inclined relative to the transport direction, wherein the at least one guide rib includes a plurality of guide ribs, and is located on a back side of the image forming apparatus relative to a center of the sheet discharged by the discharge rollers in a width direction, wherein the plurality of guide ribs includes an inner guide rib and an outer guide rib in an axial direction of the discharge rollers, wherein the inner guide rib is formed shorter than the outer guide rib with a downstream side part of the inner guide rib in the transport direction being maintained, wherein the at least one guide rib is inclined so that a length of the at least one guide rib in the direction from the bottom face of the upper member toward the discharge tray gradually increases from the upstream side to the downstream side in the transport direction, and wherein an inclination angle of an inclined face, which faces the discharge tray, of the inner guide rib relative to the bottom face of the upper member is larger than an angle of a top face, which faces the discharge tray, of the outer guide rib relative to the bottom face of the upper member.

14. The image forming apparatus according to claim 13, wherein the at least one guide rib is inclined so that a length of the at least one guide rib in the direction from the bottom face of the upper member toward the discharge tray gradually increases from the upstream side to the downstream side in the transport direction.

15. The image forming apparatus according to claim 13, wherein an auxiliary rib is disposed on the bottom face of the upper member so as to extend in a direction inclined relative to the transport direction and to be connected, with its edge, to the at least one guide rib.

16. The image forming apparatus according to claim 13, further comprising:

an image reading unit configured to read an original so as to generate image data; and an image forming unit configured to form an image on a recording sheet, the image forming unit being disposed under the image reading unit, wherein the discharge tray and the upper member are disposed in a space between the image reading unit and the image forming unit, and wherein the recording sheet on which the image has been formed by the image forming unit is discharged onto either one of the discharge tray and the upper member.

17. An image forming apparatus, comprising:

discharge rollers configured to transport a sheet in a predetermined transport direction and to discharge the sheet onto a discharge tray; and an upper member disposed above the discharge tray with a space being interposed therebetween, wherein a bottom face of the upper member that faces the discharge tray includes at least one guide rib extending in an oblique direction inclined relative to the transport direction, wherein the at least one guide rib is located on a back side of the image forming apparatus relative to a center of the sheet discharged by the discharge rollers in a width direction, and wherein an area on the back side of the bottom face of the upper member relative to the center of the sheet in the width direction is larger than an area on a front side of the bottom face of the upper member relative to the center of the sheet in the width direction.

18. The image forming apparatus according to claim 17, wherein the at least one guide rib is inclined so that a length of the at least one guide rib in the direction from the bottom face of the upper member toward the discharge tray gradually increases from the upstream side to the downstream side in the transport direction.

19. The image forming apparatus according to claim 17, wherein an auxiliary rib is disposed on the bottom face of the upper member so as to extend in a direction inclined relative to the transport direction and to be connected, with its edge, to the at least one guide rib.

20. The image forming apparatus according to claim 17, further comprising:

an image reading unit configured to read an original so as to generate image data; and an image forming unit configured to form an image on a recording sheet, the image forming unit being disposed under the image reading unit, wherein the discharge tray and the upper member are disposed in a space between the image reading unit and the image forming unit, and wherein the recording sheet on which the image has been formed by the image forming unit is discharged onto either one of the discharge tray and the upper member.

* * * * *